US011145260B2

(12) United States Patent
Calayir et al.

(10) Patent No.: US 11,145,260 B2
(45) Date of Patent: Oct. 12, 2021

(54) DISPLAY BACKLIGHTING SYSTEMS AND METHODS FOR ADAPTIVE PULSE WIDTH MODULATION AND MODULO PULSE WIDTH MODULATION

(71) Applicant: Apple Inc., Cupertino, CA (US)

(72) Inventors: Vehbi Calayir, San Jose, CA (US); James E. Brown, San Jose, CA (US); Venkataraman V. Iyer, Sunnyvale, CA (US); Bret Rothenberg, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/836,617

(22) Filed: Mar. 31, 2020

(65) Prior Publication Data

US 2020/0380925 A1 Dec. 3, 2020

Related U.S. Application Data

(60) Provisional application No. 62/853,584, filed on May 28, 2019.

(51) Int. Cl.
*G09G 3/36* (2006.01)
*G09G 3/34* (2006.01)

(52) U.S. Cl.
CPC ..... *G09G 3/3426* (2013.01); *G09G 3/3611* (2013.01); *G09G 2310/08* (2013.01); *G09G 2320/0233* (2013.01); *G09G 2320/064* (2013.01); *G09G 2320/0633* (2013.01)

(58) Field of Classification Search
CPC ..... G09G 3/3426; G09G 3/3611; G09G 2310/08; G09G 2320/0233; G09G 2320/0633; G09G 2320/064
See application file for complete search history.

(56) References Cited

U.S. PATENT DOCUMENTS

| | | | | |
|---|---|---|---|---|
| 8,355,033 | B2 | 1/2013 | Deppe | |
| 9,390,647 | B2 | 7/2016 | Li et al. | |
| 9,524,679 | B2 | 12/2016 | Aitken et al. | |
| 2010/0097412 | A1* | 4/2010 | Okabe | H05B 45/37 345/691 |
| 2014/0292832 | A1* | 10/2014 | Chang | G09G 3/2014 345/690 |
| 2016/0219663 | A1* | 7/2016 | Chen | H05B 45/10 |
| 2016/0293115 | A1* | 10/2016 | Yamashita | G09G 3/3406 |

* cited by examiner

*Primary Examiner* — Towfiq Elahi
(74) *Attorney, Agent, or Firm* — Aikin & Gallant, LLP

(57) ABSTRACT

Aspects of the subject technology relate to an electronic device with a display. The display includes an array of light-emitting diodes. The array includes a plurality of subarrays of the light-emitting diodes. At least one driver circuit is coupled to the array of light-emitting diodes. The at least one driver circuit is configured to generate an adaptive pulse-width modulated (PWM) signal to control at least one subarray of the plurality of subarrays of the light-emitting diodes. The adaptive PWM signal is designed with each pulse of a group having a pulse width W, each pulse width being reduced until reaching a threshold pulse width, and one pulse being removed from the group of pulses.

25 Claims, 33 Drawing Sheets

*SPEC FLAT ABOVE 40 nits

DISPLAY BACKLIGHTING SYSTEMS AND METHODS FOR ADAPTIVE PULSE WIDTH MODULATION AND MODULO PULSE WIDTH MODULATION

CROSS-REFERENCE

This application claims benefit of U.S. Provisional Patent Application No. 62/853,584 filed May 28, 2019, which is hereby incorporated herein by reference

TECHNICAL FIELD

The present description relates generally to electronic devices with displays, and more particularly, but not exclusively, to electronic devices with displays having backlights with local dimming.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Liquid crystal displays commonly include a backlight unit and a liquid crystal display unit with individually controllable liquid crystal display pixels.

The backlight unit commonly includes one or more light-emitting diodes (LEDs) that generate light that exits the backlight toward the liquid crystal display unit. The liquid crystal display pixels are individually operable to control passage of light from the backlight unit through that pixel to display content such as text, images, video, or other content on the display.

SUMMARY OF THE DESCRIPTION

In accordance with various aspects of the subject disclosure, an electronic device with a display is provided. The display includes an array of light-emitting diodes. The array includes a plurality of subarrays of the light-emitting diodes. At least one driver circuit is coupled to the array of light-emitting diodes. The at least one driver circuit is configured to generate an adaptive pulse-width modulated (PWM) signal to control at least one subarray of the plurality of subarrays of the light-emitting diodes. The adaptive PWM signal is designed with each pulse of a group having a pulse width W, each pulse width being reduced until reaching a threshold pulse width, and one pulse being removed from the group of pulses.

In accordance with other aspects of the subject disclosure, a control circuitry includes an array of light emitting diodes (LEDs) having controllable brightness levels and display driver circuitry for driving the array of light emitting diodes (LEDs). The display driver circuitry is configured to generate for lower brightness levels below a threshold brightness level a PWM signal including at least one of a first modulo PWM signal that modifies a pulse width of one pulse per line of a pulse train or a second modulo PWM signal that partitions pulses of backlight updates into groups based on consecutive self-refresh cycles of a backlight update for controlling the brightness of the array of the LEDs.

In accordance with other aspects of the subject disclosure, an electronic device comprises an array of light-emitting diodes (LEDs) and processing circuitry to execute instructions to receive a pulse-width modulated (PWM) code, and to modify the code to generate a modified PWM code having PWM offset functionality. Driver circuitry is coupled to the array of LEDs. The driver circuitry is configured to generate a PWM signal based on the modified PWM code to control the array of the light-emitting diodes with the PWM offset functionality.

In accordance with other aspects of the subject disclosure, an electronic device comprises an array of light-emitting diodes (LEDs) and processing circuitry to execute instructions to receive a pulse-width modulated (PWM) code and to modify the code to generate a modified PWM code having PWM bias functionality. Driver circuitry is coupled to the array of LEDs. The driver circuitry is configured to generate a PWM signal based on the modified PWM code to control the array of the light-emitting diodes with the PWM bias functionality.

In accordance with other aspects of the subject disclosure, an electronic device comprises an array of light-emitting diodes (LEDs) and processing circuitry to execute an algorithm to determine a desired brightness level for the array of LEDs, to determine whether the desired brightness level is greater than a threshold brightness level, and to cause a pulse-width modulated (PWM) signal or pulse-amplitude modulated (PAM) signal to be generated based on the whether the desired brightness level is greater than the threshold brightness level.

BRIEF DESCRIPTION OF THE DRAWINGS

Certain features of the subject technology are set forth in the appended claims. However, for purpose of explanation, several embodiments of the subject technology are set forth in the following figures.

Figure 7A:
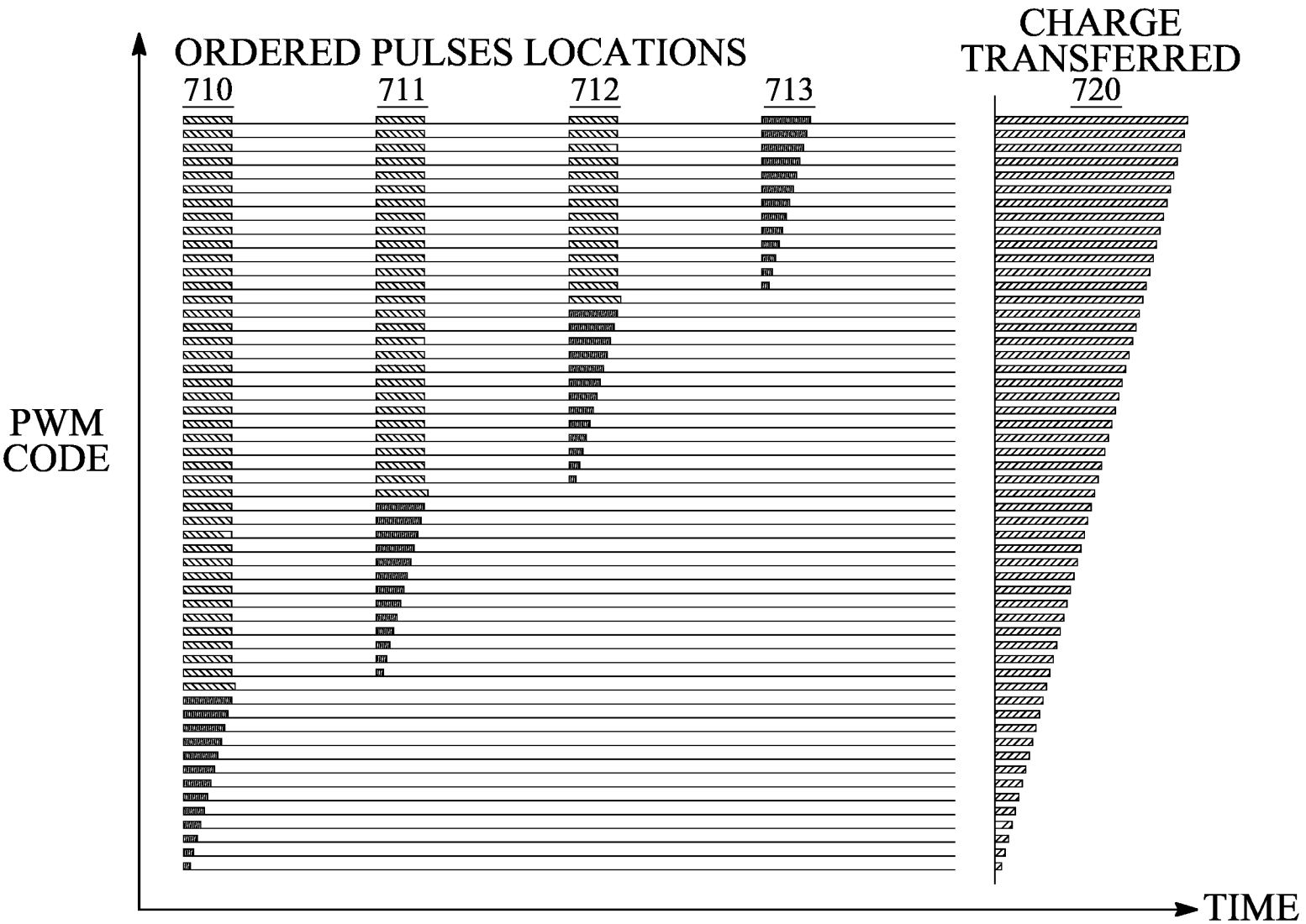
Figure 7B:
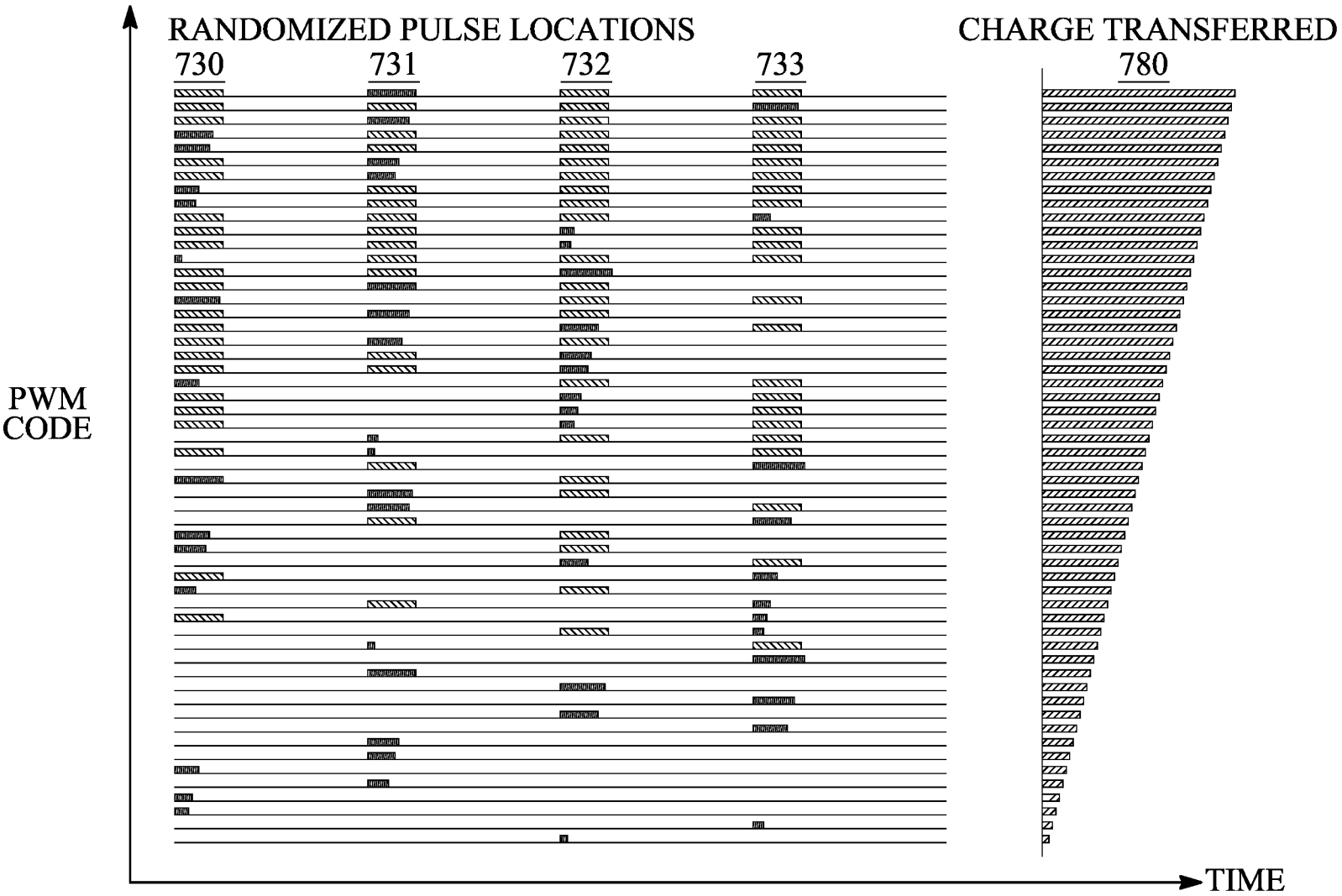

Examples of pulses for modulo PWM are illustrated in FIGS. 7A and 7B in accordance with one embodiment.

Figure 8A:
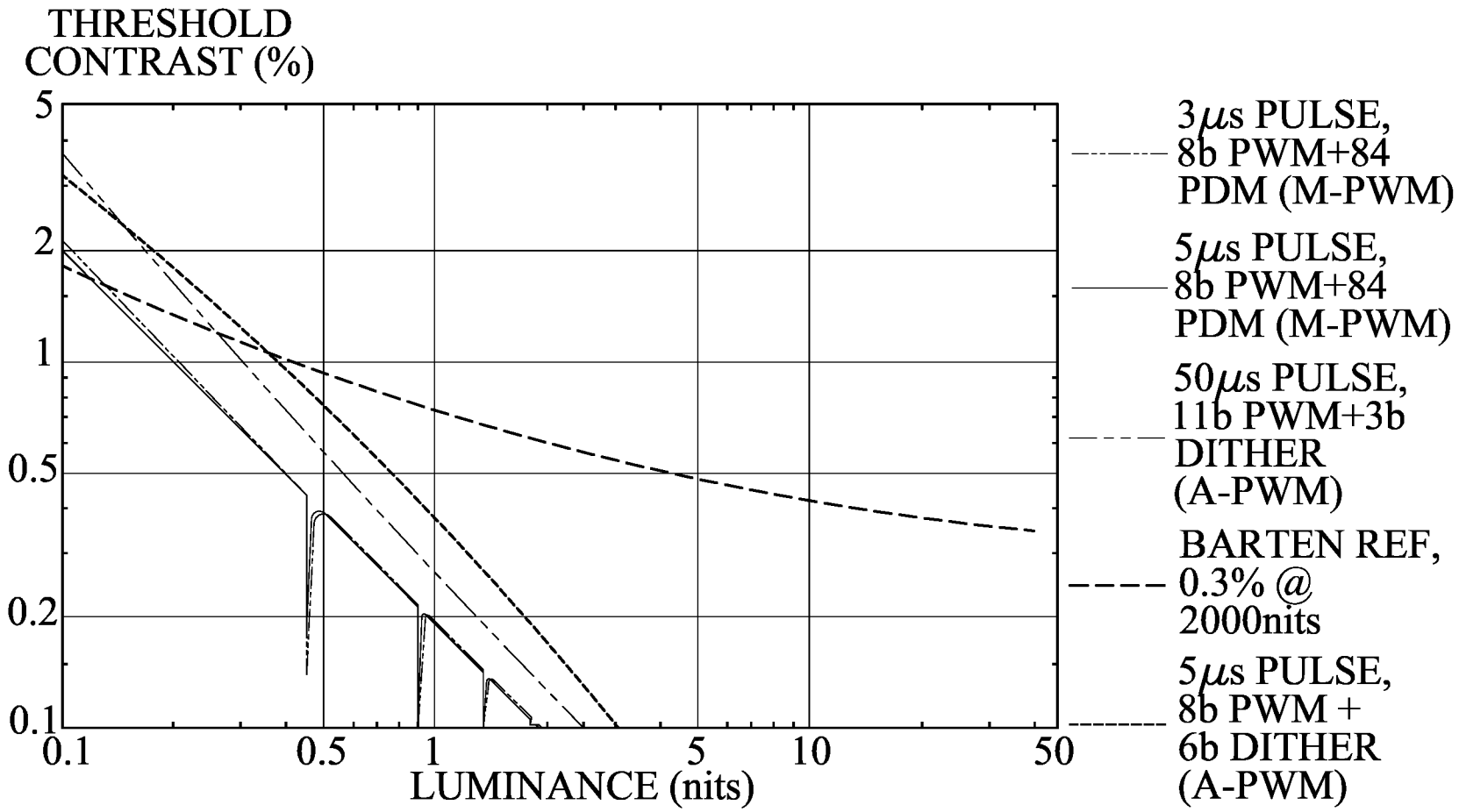

FIG. 8A illustrates threshold contrast % for adaptive and modulo PWM pulses in one example.

Figure 8B:
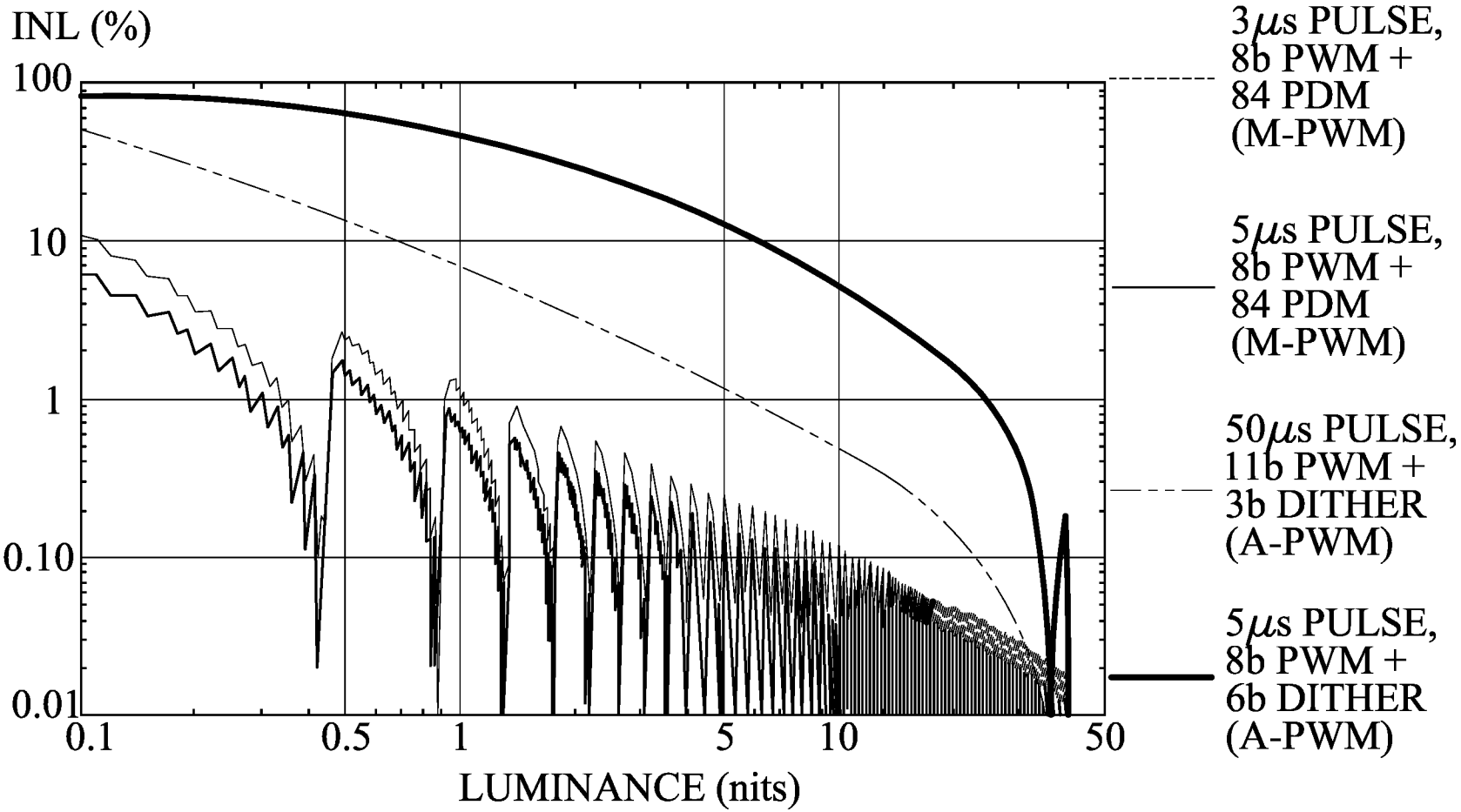

FIG. 8B illustrates linearity for adaptive and modulo PWM pulses in one example.

Figure 8C:
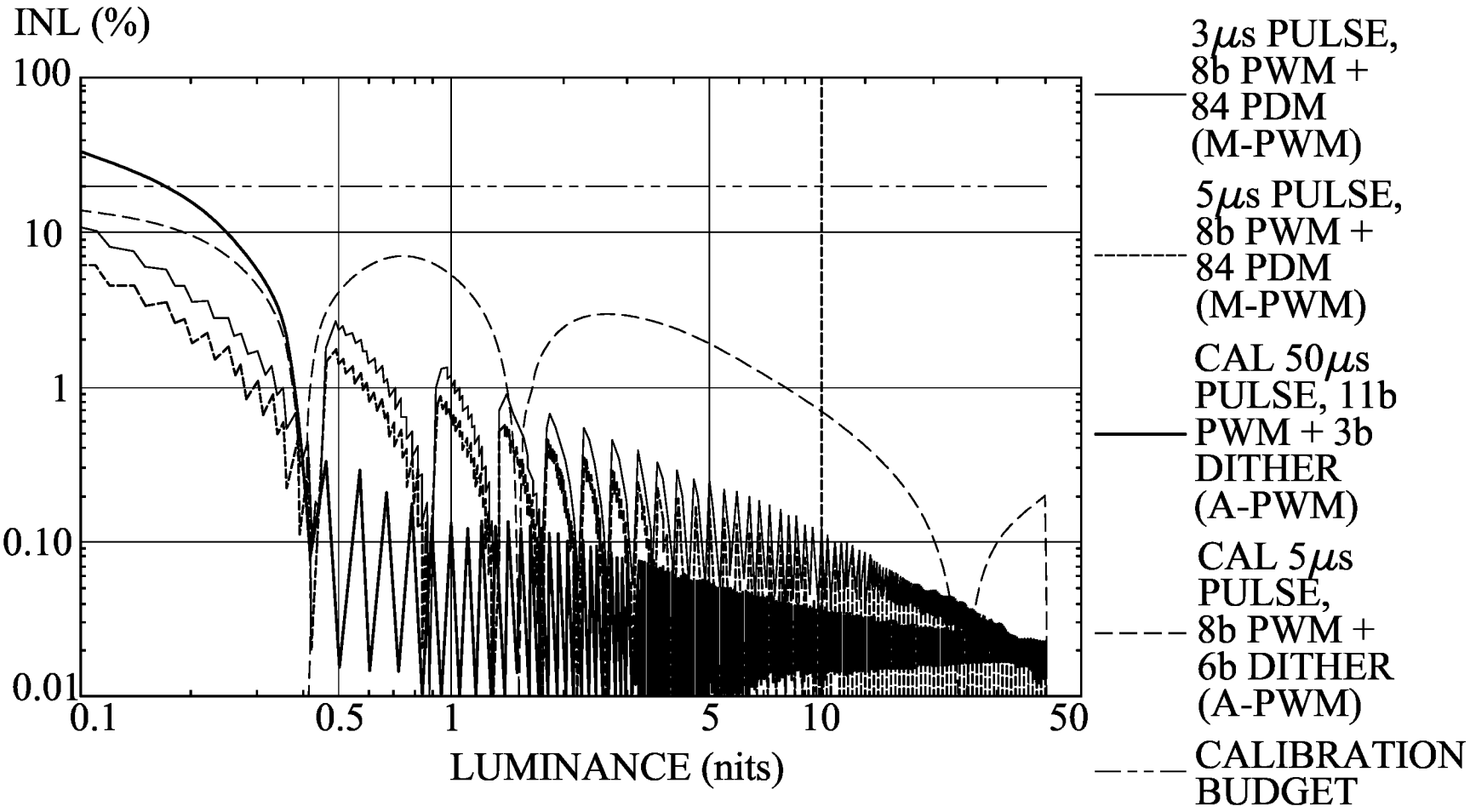

FIG. 8C illustrates multiple calibrations points (e.g., 0.4 nit, 1.5 nit, 40 nit) to improve linearity for 50 us pulse and 5 us pulse based on additional zeros at 0.4 nit and 1.5 nit.

Figure 8D:
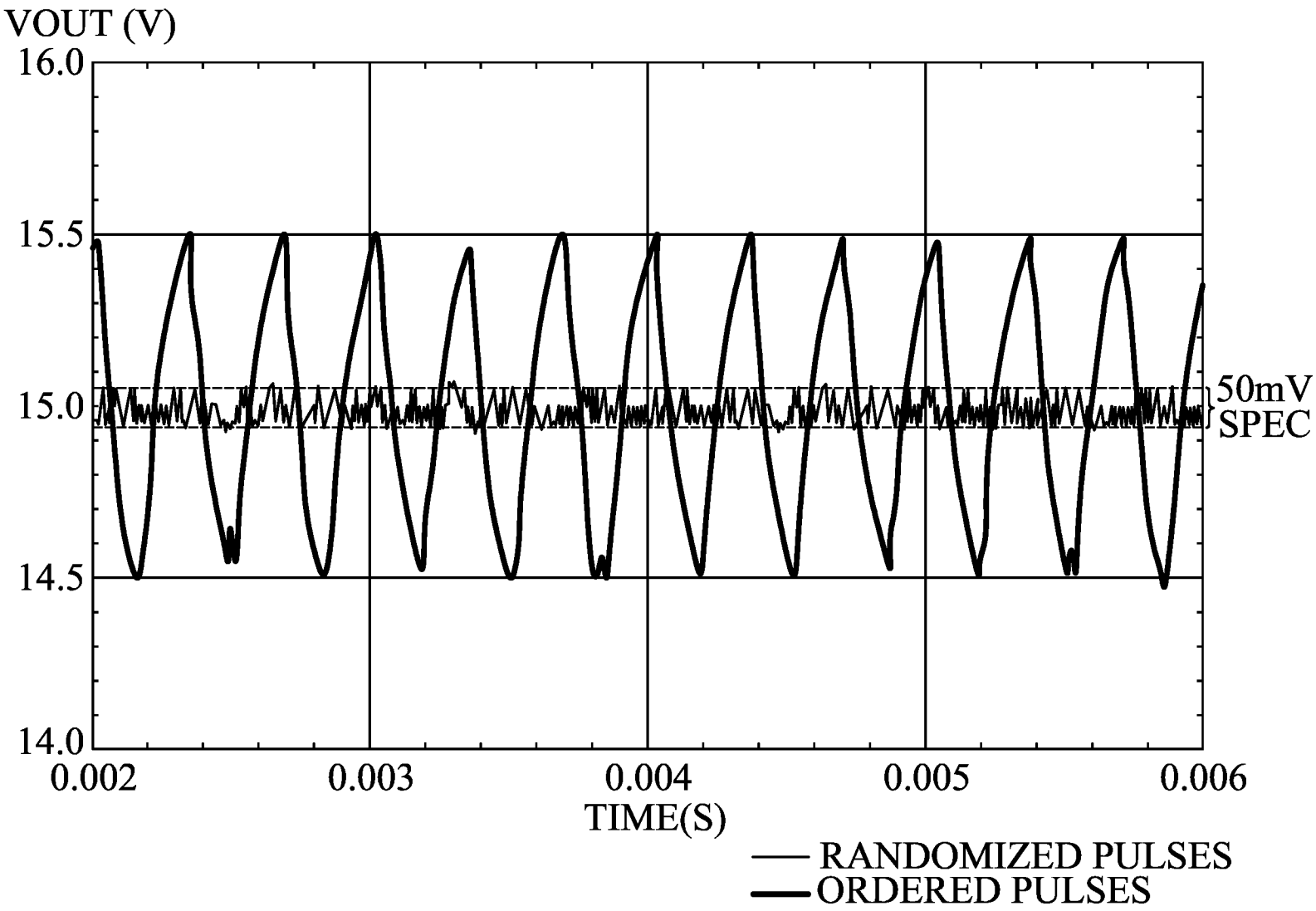

FIG. 8D illustrates how randomized pulse locations mitigate acoustic noise problems by spreading the noise and cause reduced ripple on a power converter output that provides power to LEDs.

Figure 9:
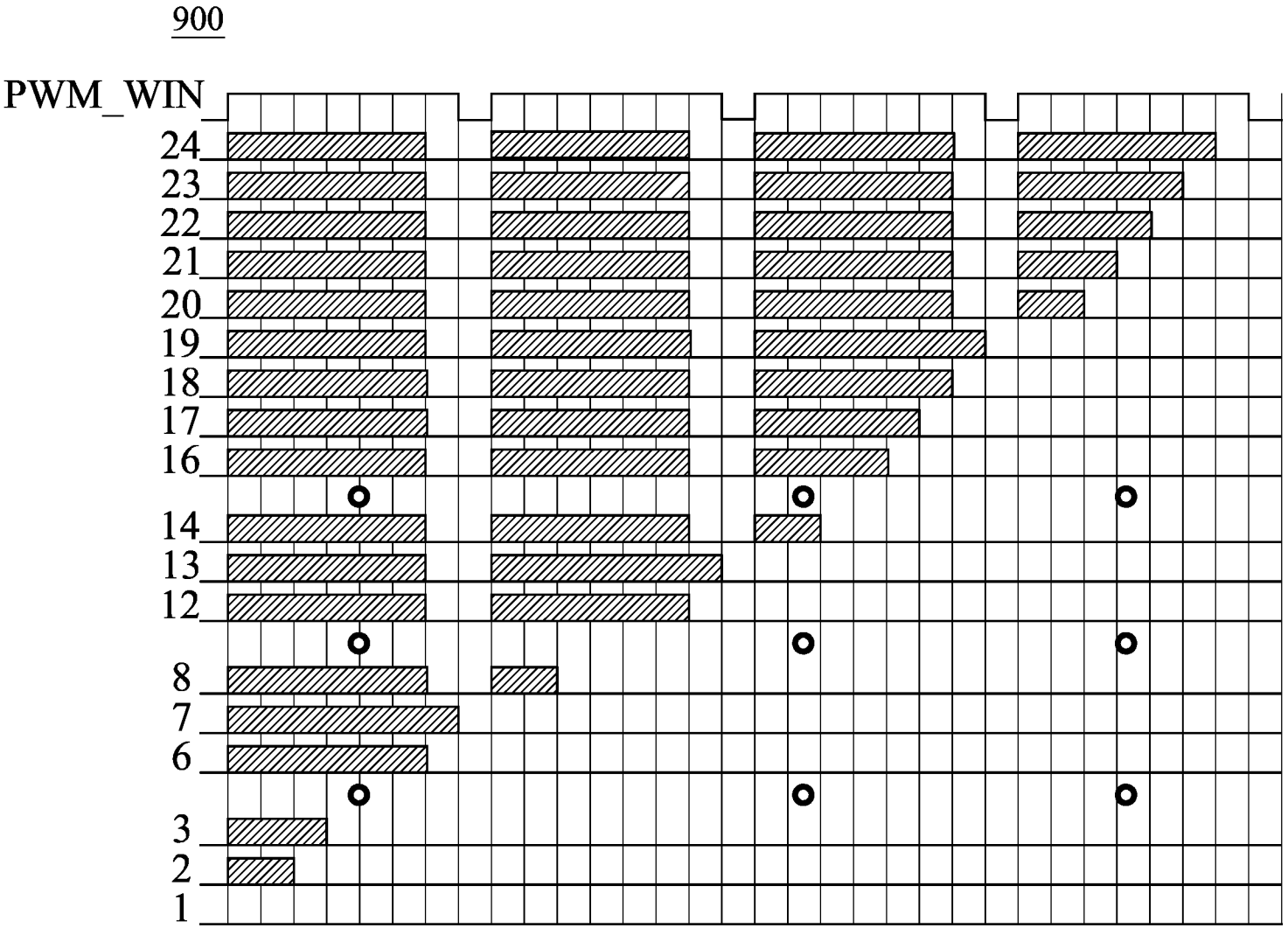

FIG. 9 illustrates pulse conditions for modulo PWM 900 in accordance with one embodiment.

Figure 10:
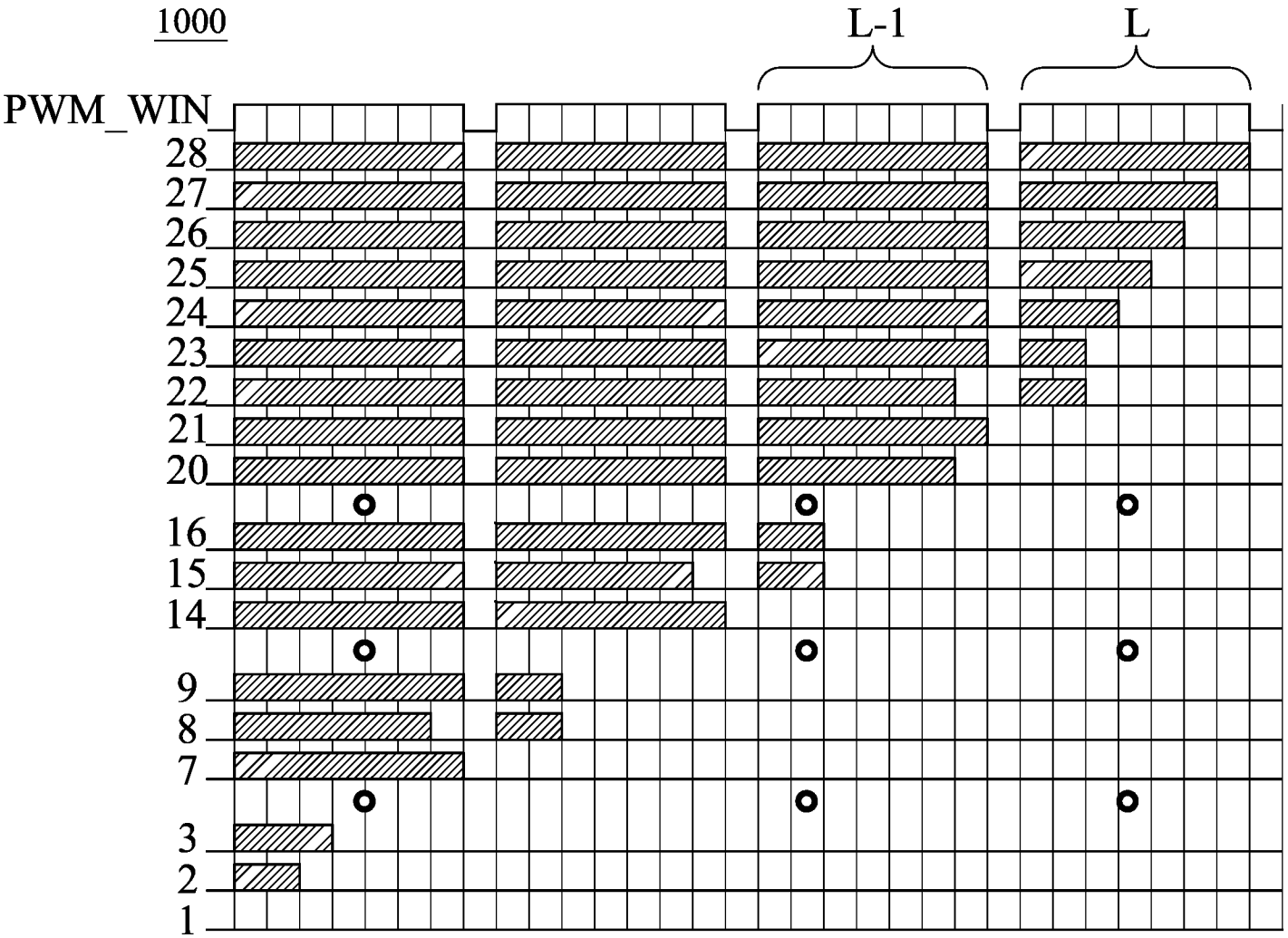

FIG. 10 illustrates pulse conditions for modulo PWM in accordance with another embodiment.

Figure 11A:
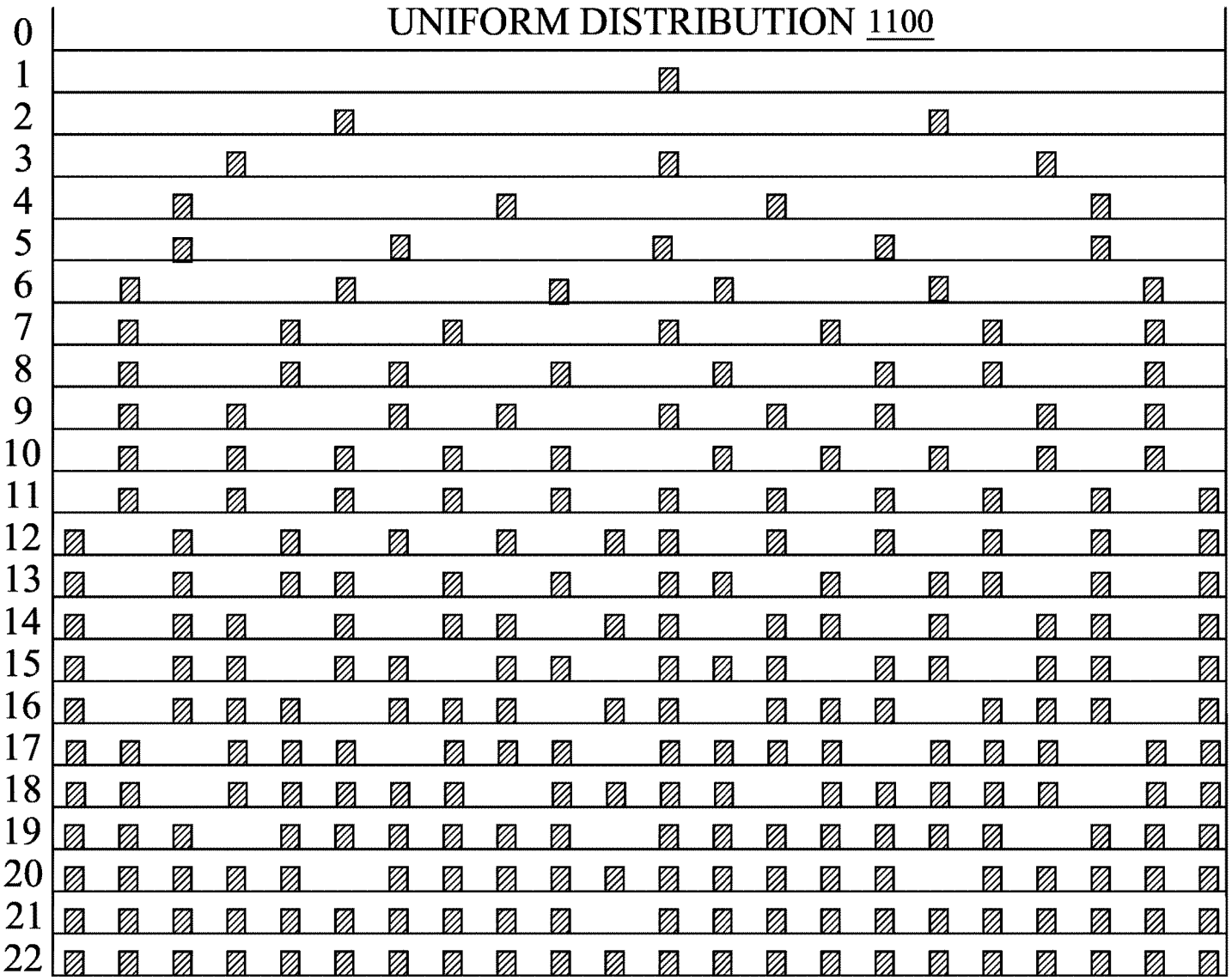
Figure 11B:
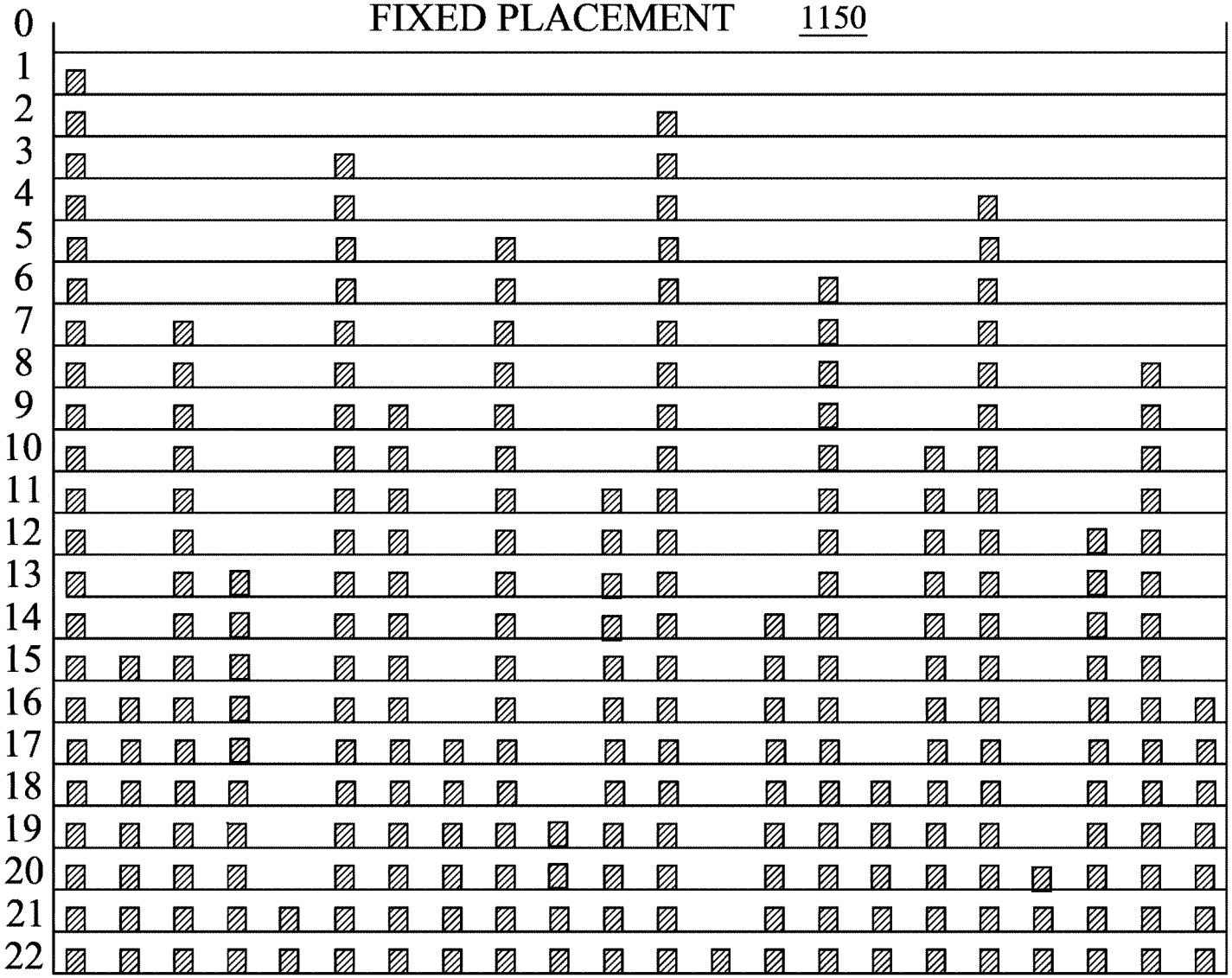

The diagrams 1100 and 1150 of FIGS. 11A and 11B show two methods to spread pulses.

Figure 12:
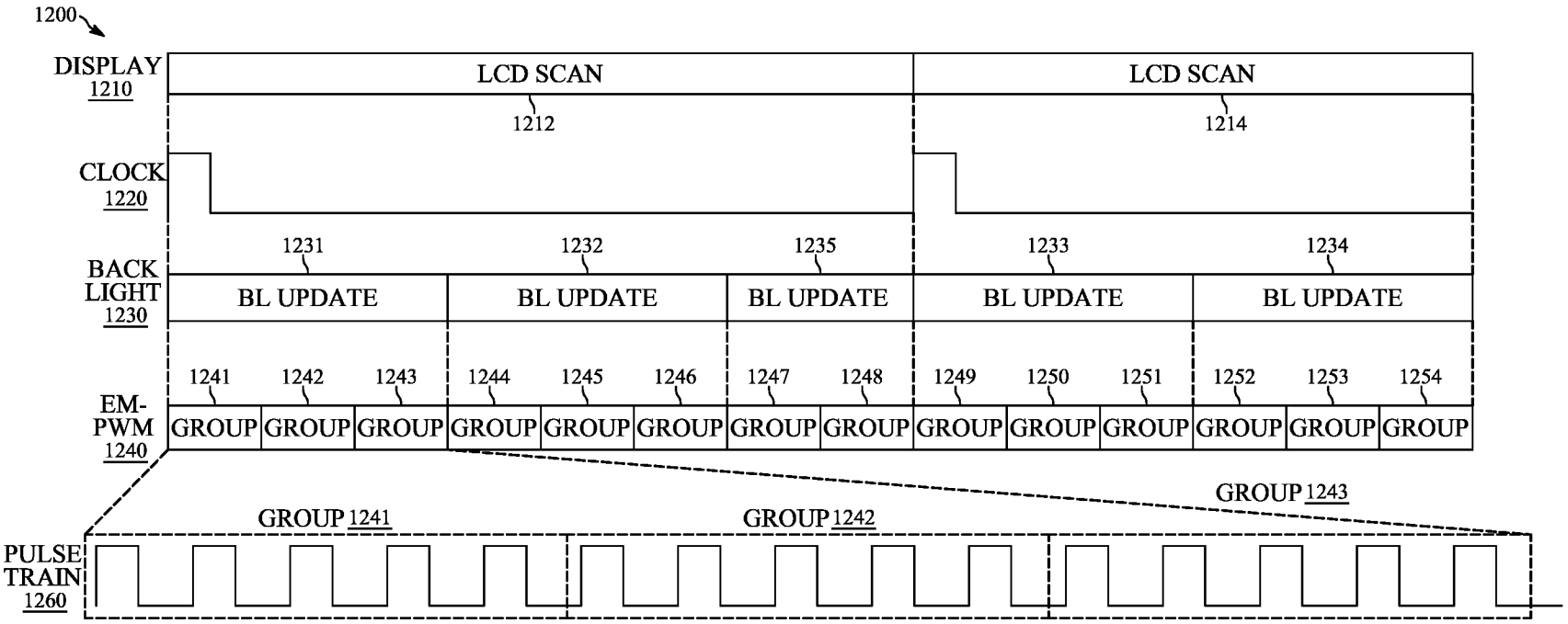

FIG. 12 illustrates a timing diagram for pulse conditions and partitioning for enhanced modulo PWM in accordance with another embodiment.

Figure 13A:
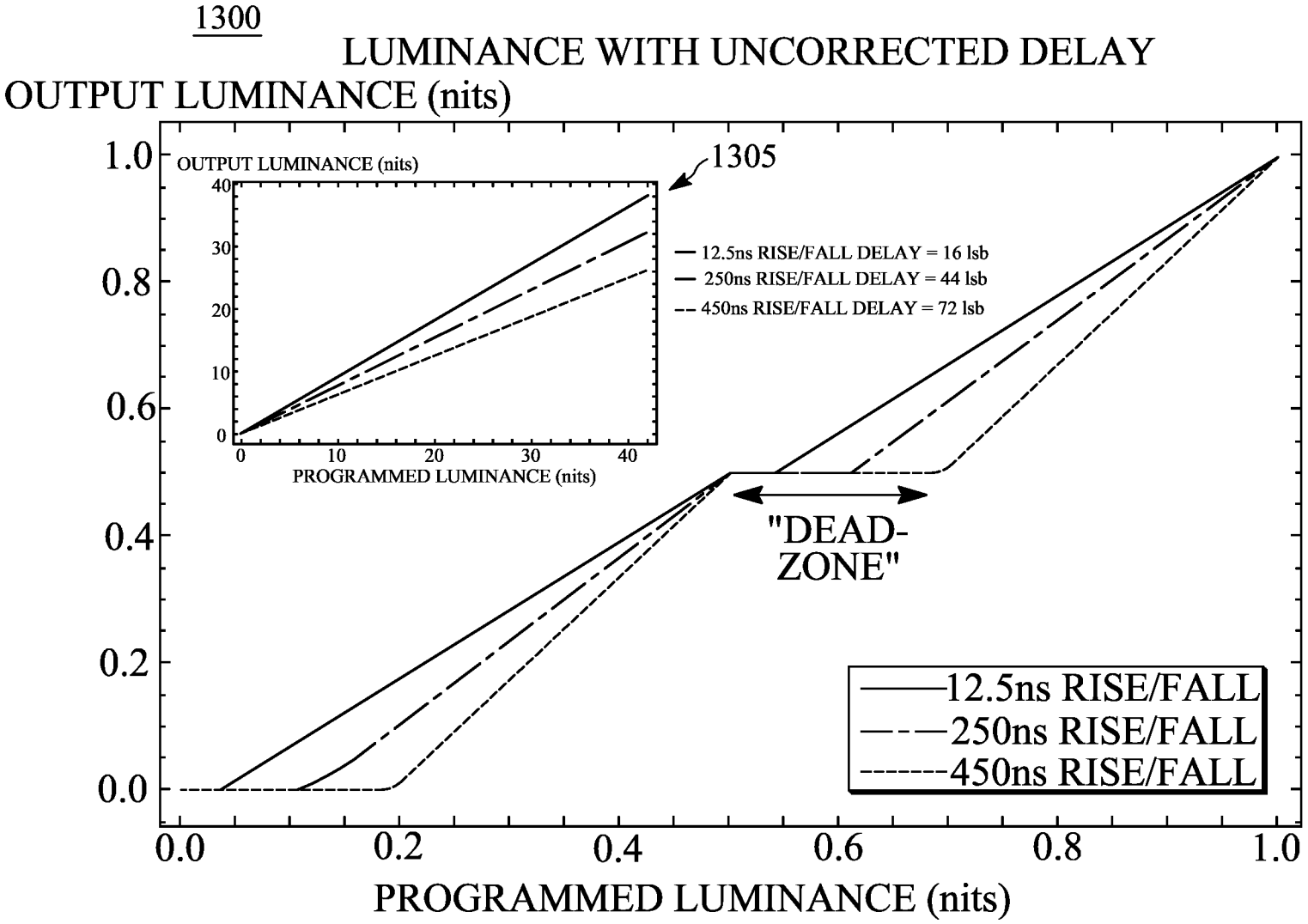

FIG. 13A illustrates an output luminance versus programmed luminance diagram 1300 having uncorrected delay with a dead-zone due to longer rise/fall times.

Figure 13B:
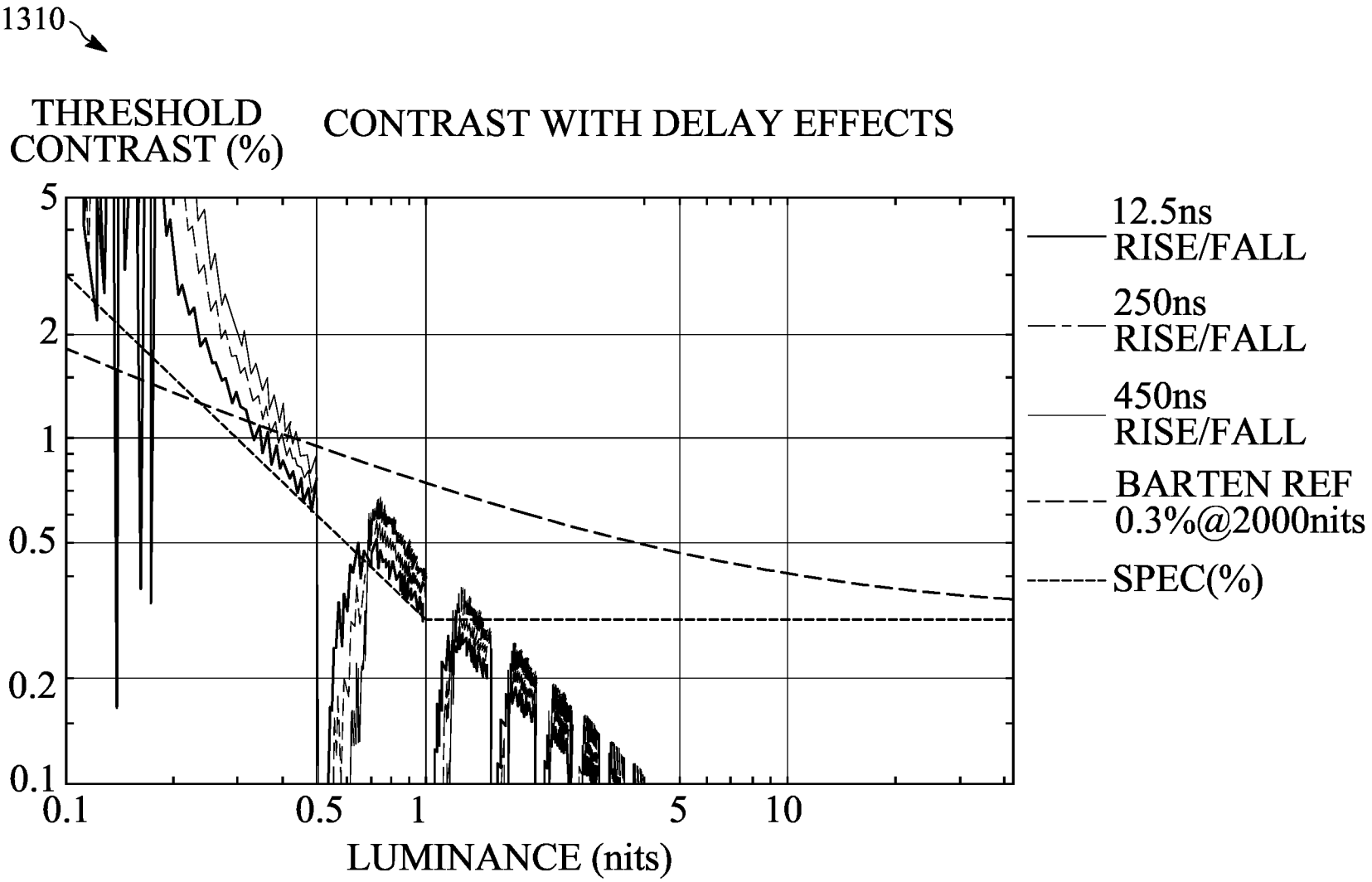

FIG. 13B illustrates a threshold contrast diagram 1310 with delay effects.

Figure 13C:
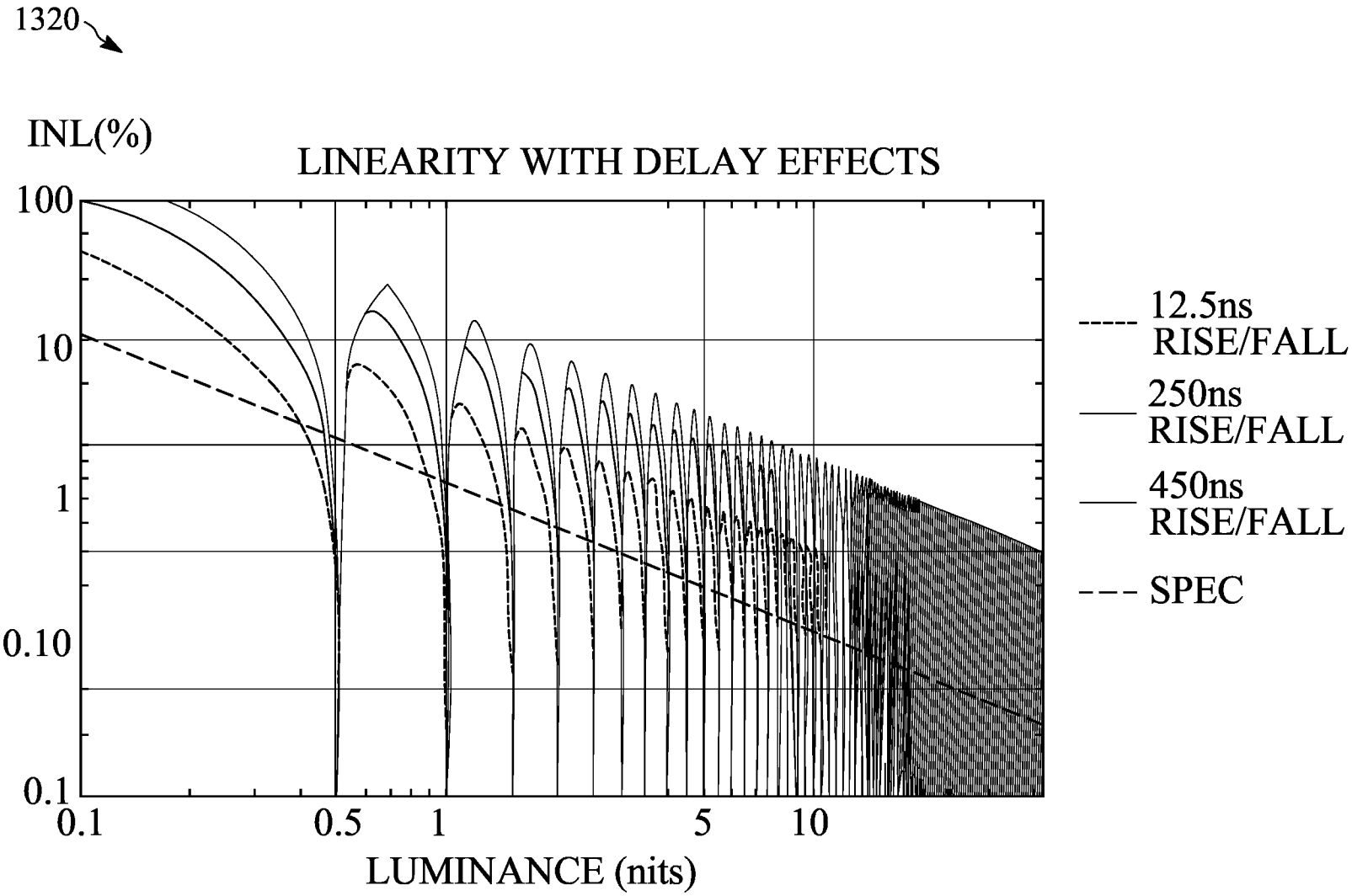

FIG. 13C illustrates a linearity diagram 1320 with delay effects.

Figure 13D:
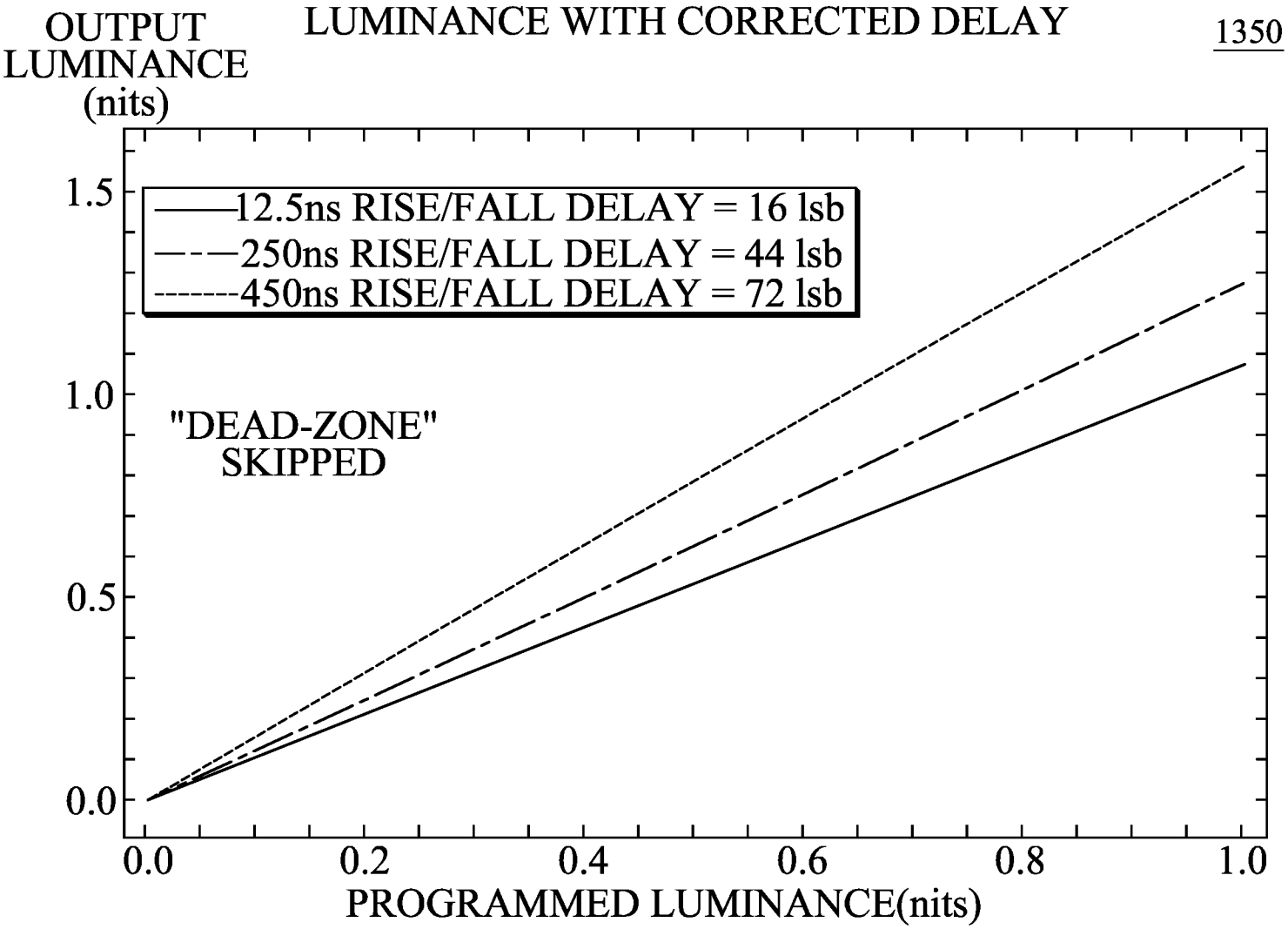

FIG. 13D illustrates an output luminance versus programmed luminance diagram 1350 having corrected delay with no dead-zone due to a PWM offset.

Figure 13E:
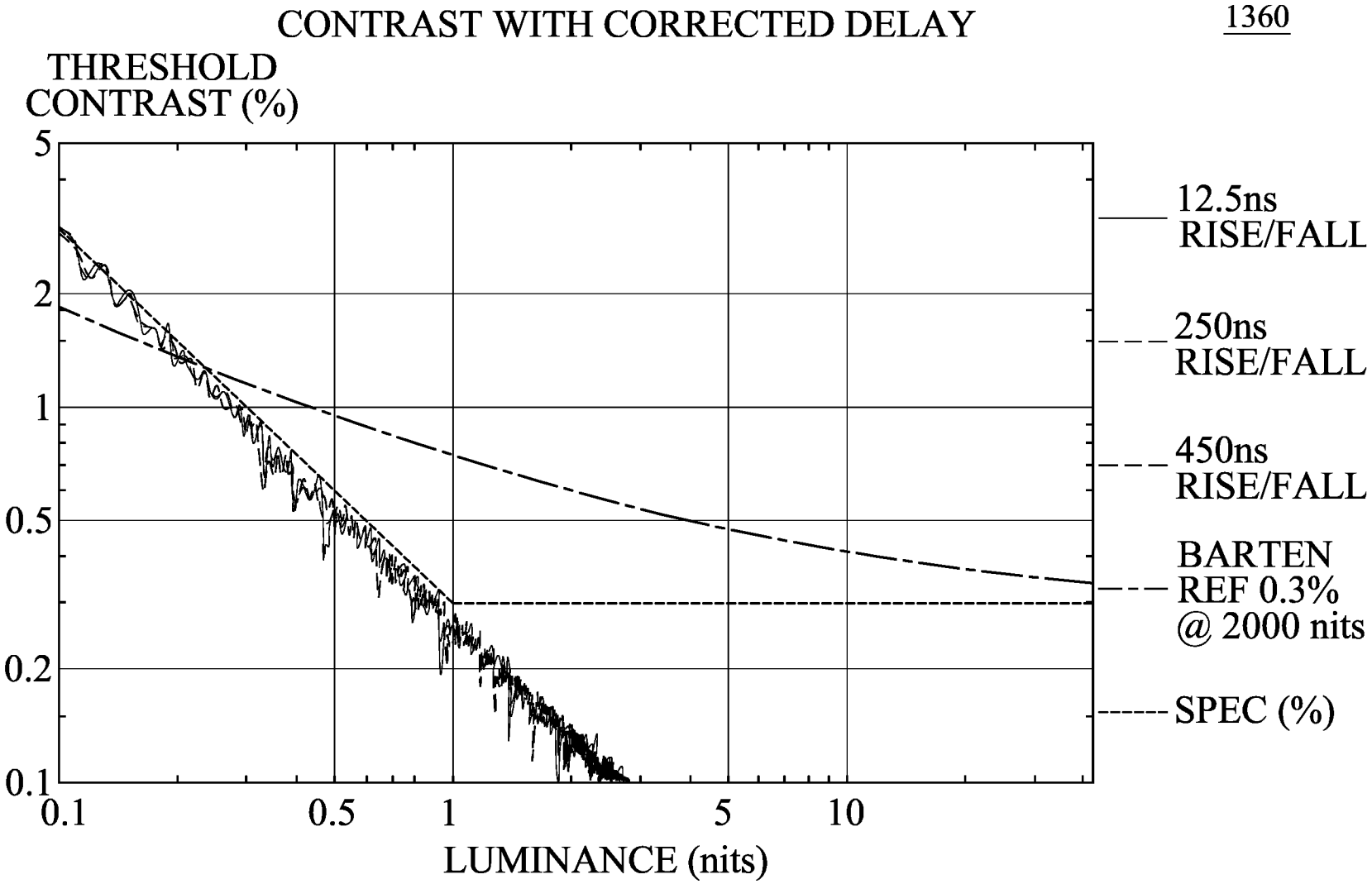

FIG. 13E illustrates a threshold contrast diagram 1360 with the threshold contrast having corrected delay for 12.5 ns, 250 ns, and 450 ns rise/fall signals.

Figure 13F:
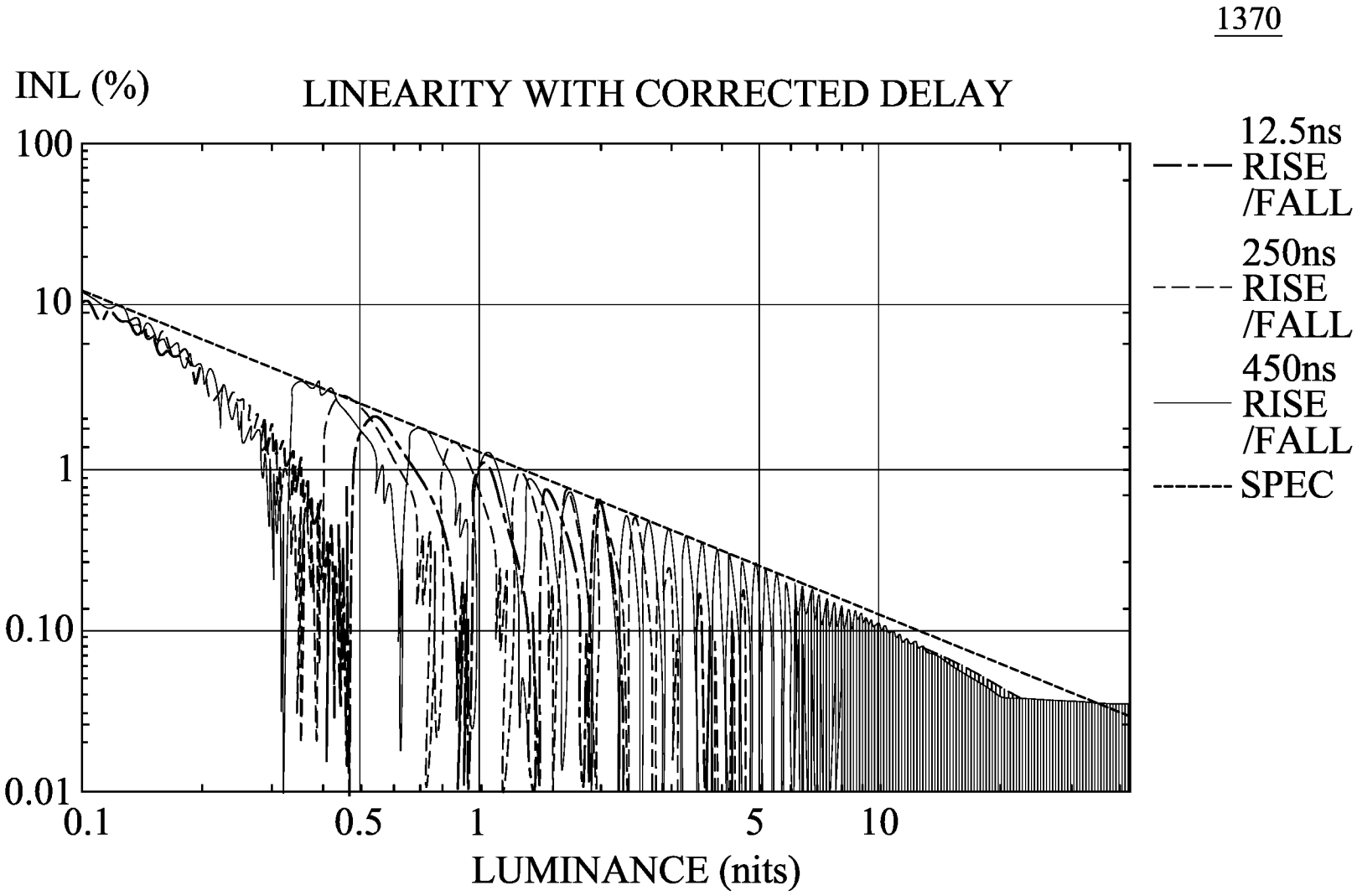

FIG. 13F illustrates a linearity diagram 1370 having corrected delay for 12.5 ns, 250 ns, and 450 ns rise/fall signals and these signals being within an electrical specification due to the PWM offset.

Figure 14B:
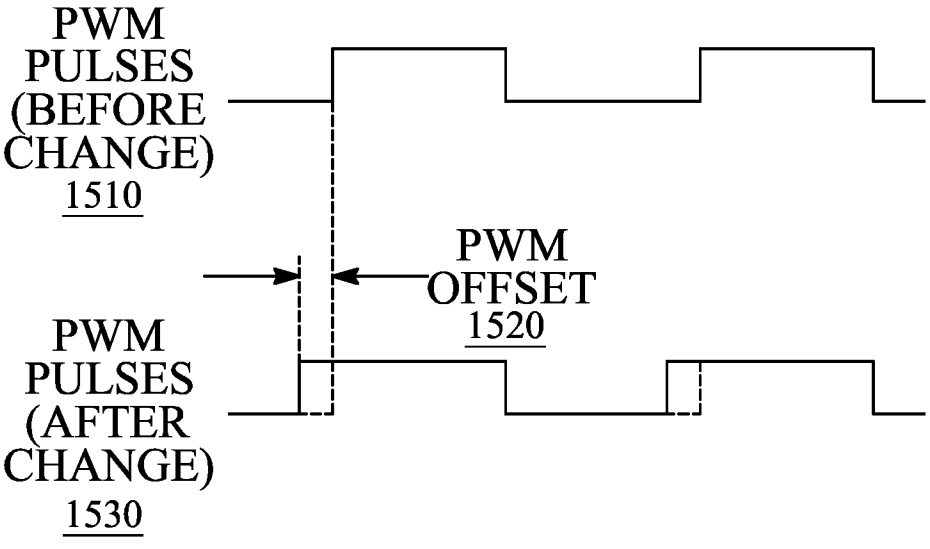
Figure 14A:
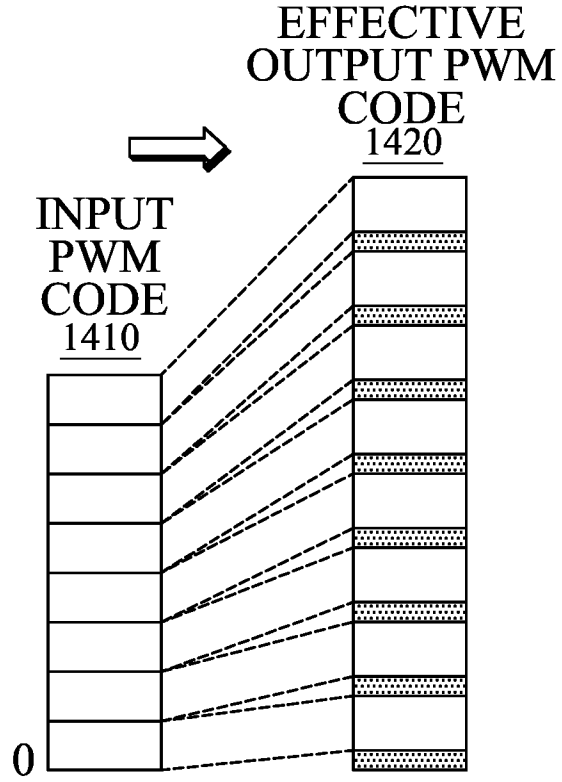

FIG. 14A illustrates how an input PWM code 1410 is changed to be an effective output PWM code 1420 that includes the shaded bits for the PWM offset.

In one example, a fixed 5-bit width is added to all pulses as illustrated in FIG. 14B.

Figure 15A:
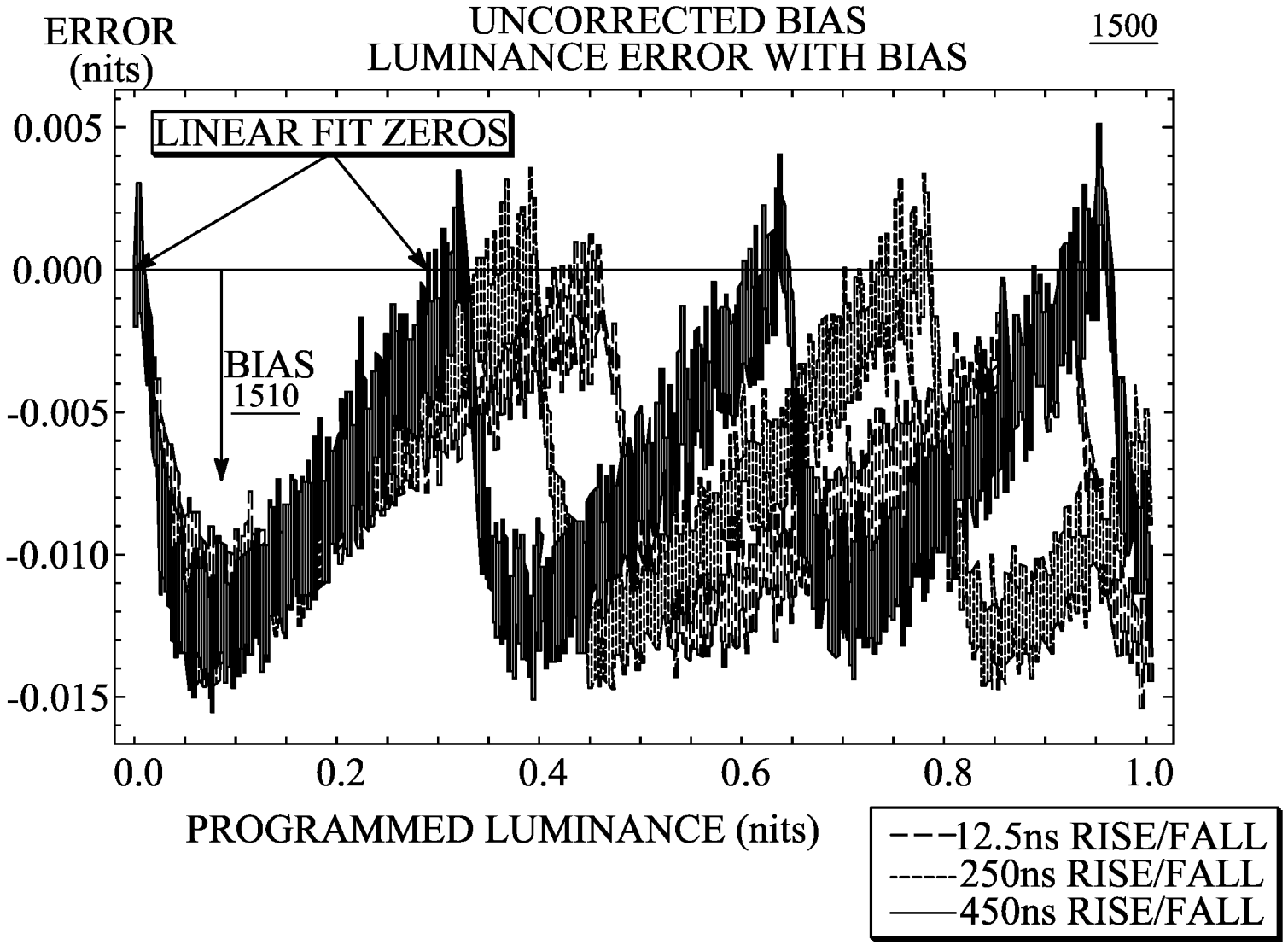

FIG. 15A illustrates an uncorrected bias luminance error versus programmed luminance diagram 1500 for shorter rise/fall times.

Figure 15B:
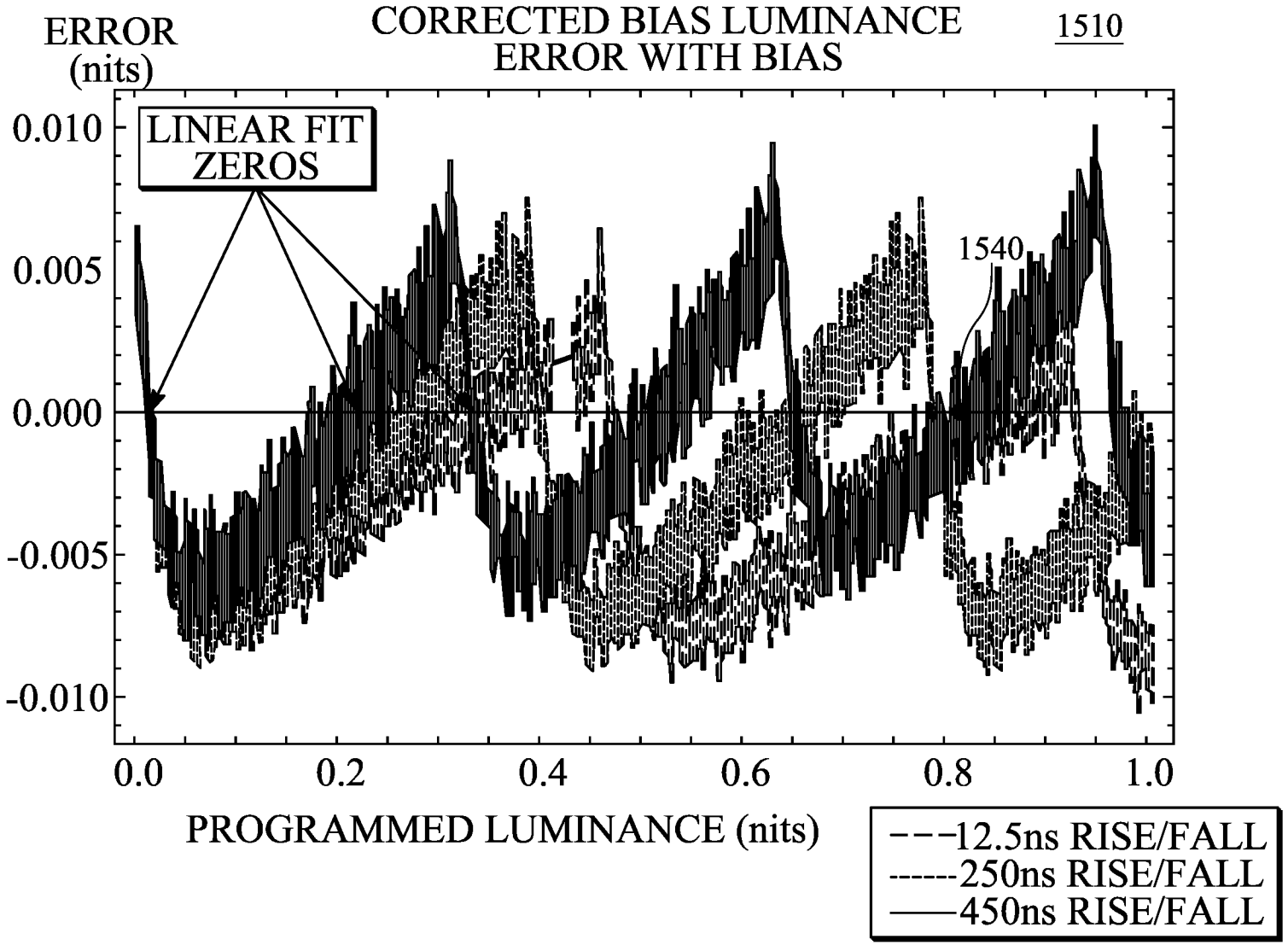

FIG. 15B illustrates a corrected bias luminance error versus programmed luminance diagram 1510 for shorter rise/fall times in accordance with one embodiment.

Figure 15C:
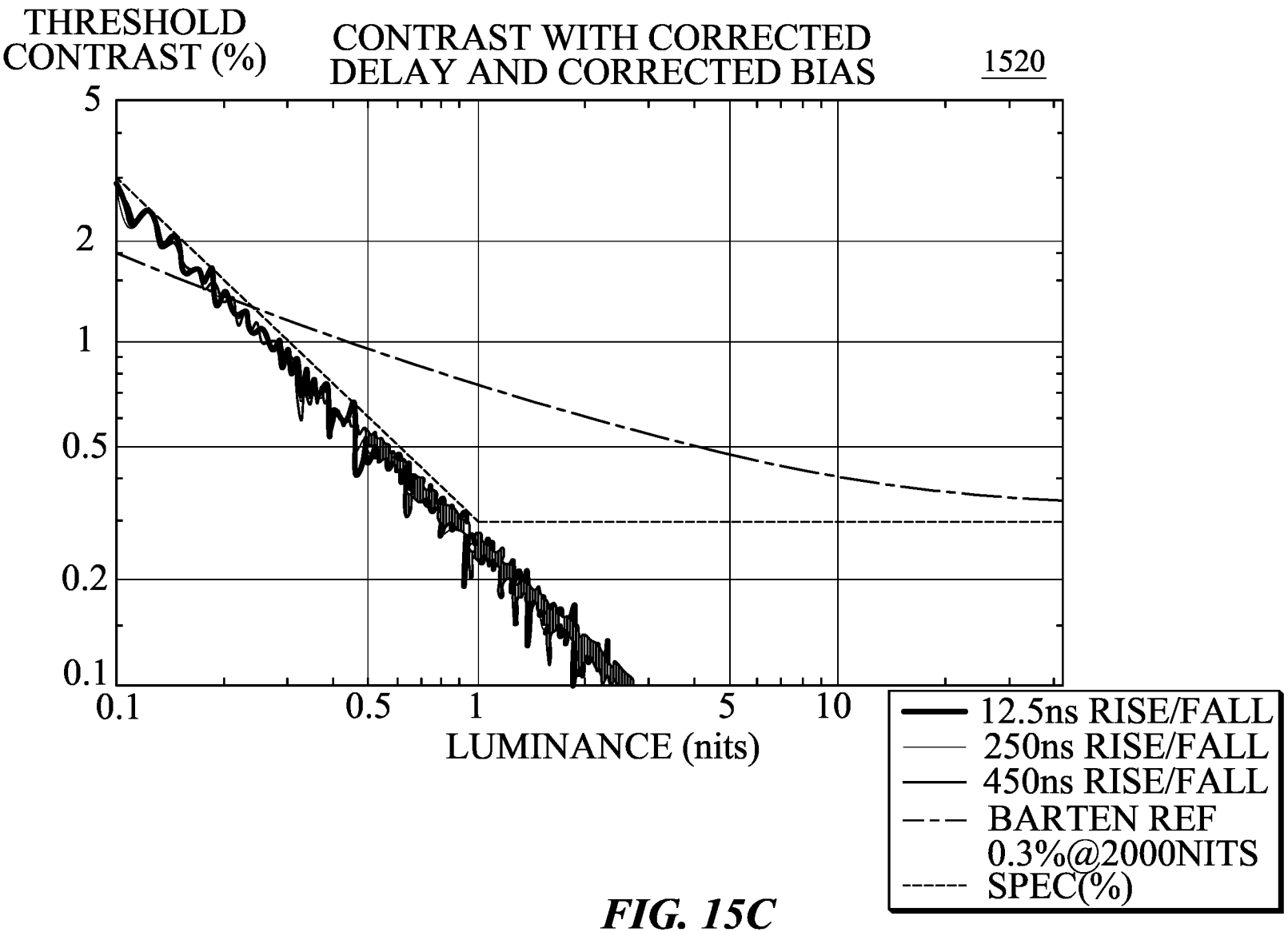

FIG. 15C illustrates a threshold contrast diagram 1520 with the threshold contrast being within an electrical specification due to corrected delay and corrected biasing with the biasing bits.

Figure 15D:
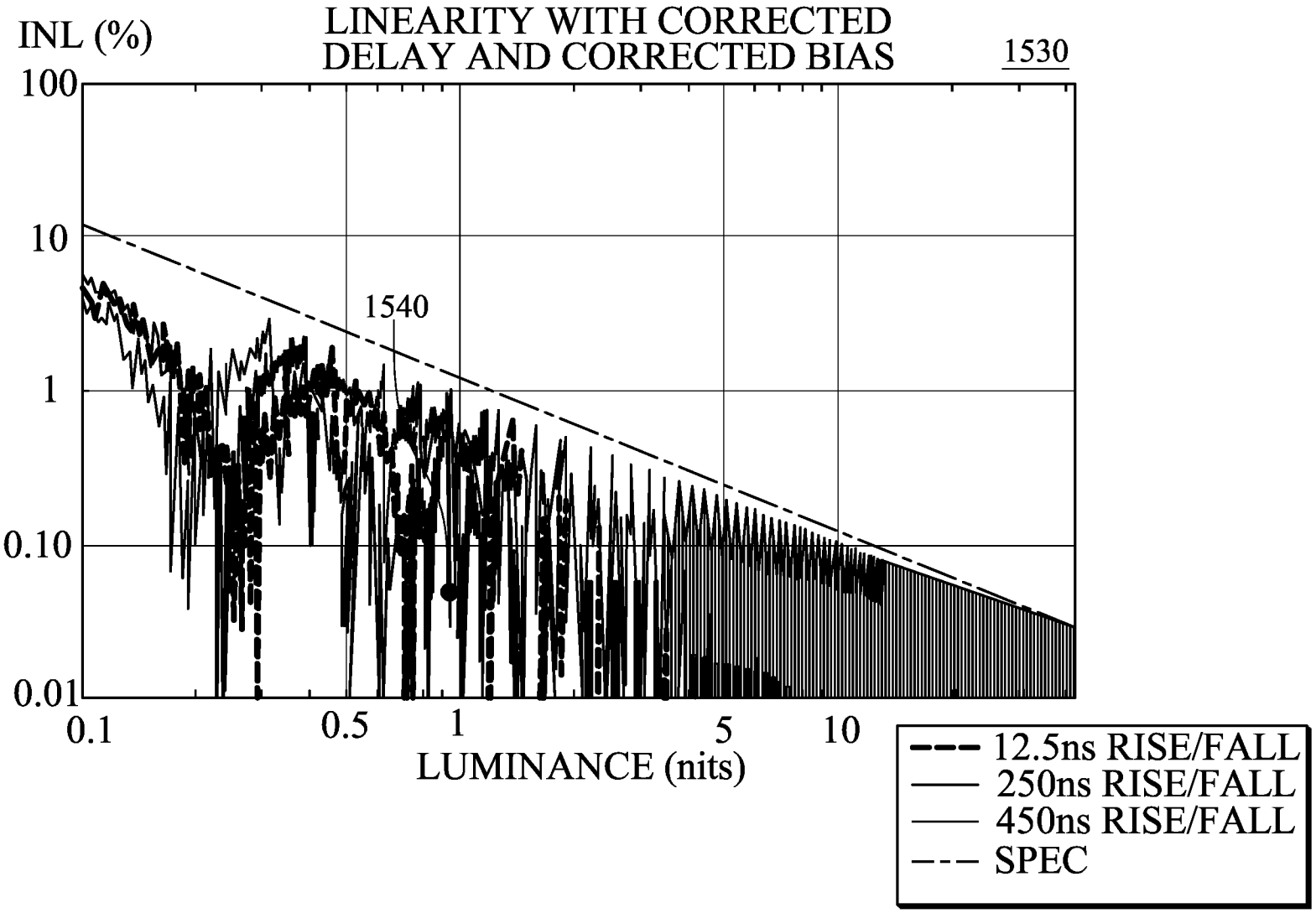

FIG. 15D illustrates linearity with corrected delay and corrected bias versus luminance for shorter rise/fall times in accordance with one embodiment.

Figure 15E:
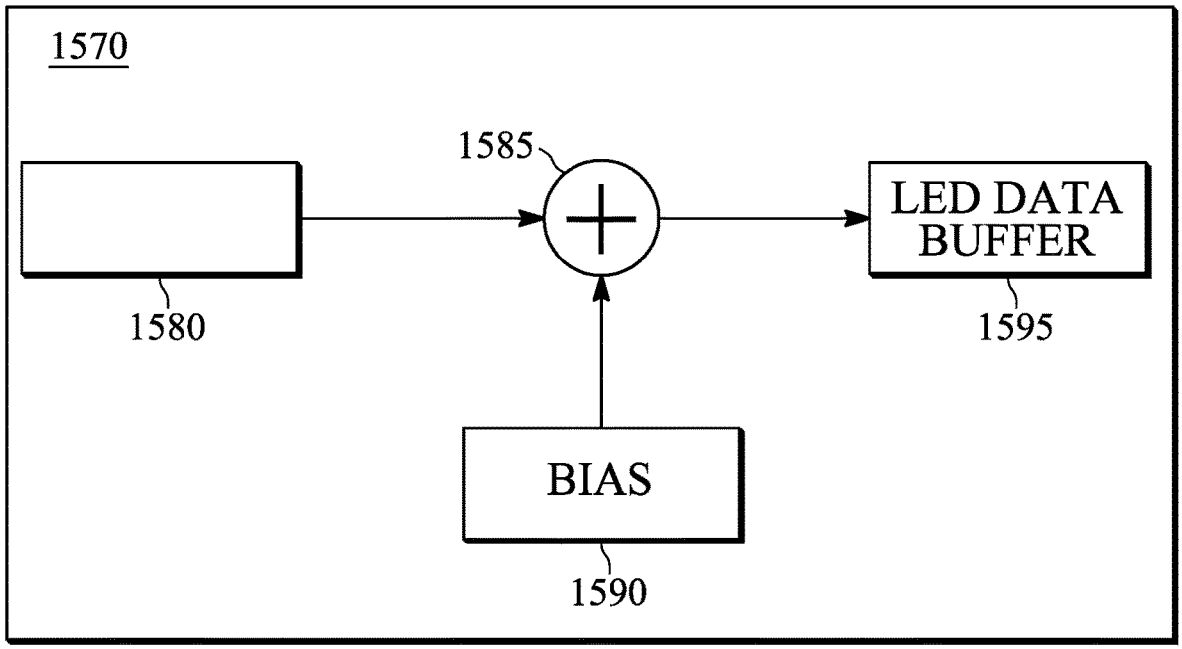

FIG. 15E illustrates a block diagram of PWM biasing circuitry for adding biasing bits to a data buffer in accordance with one embodiment.

Figure 16B:
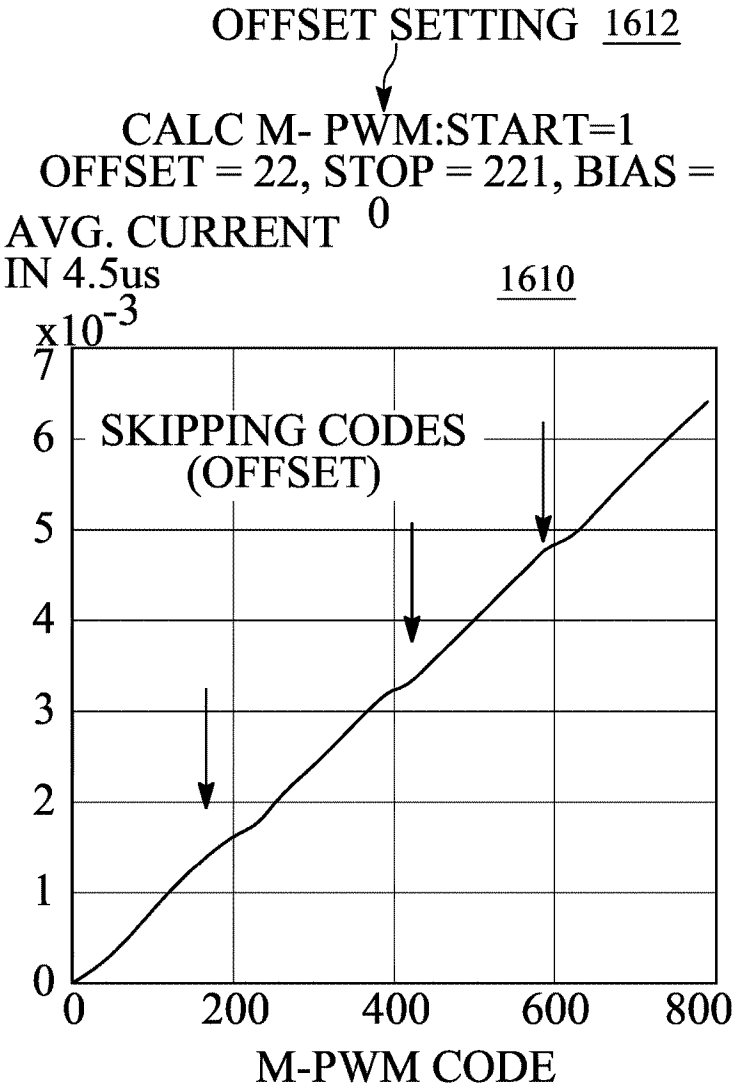
Figure 16A:
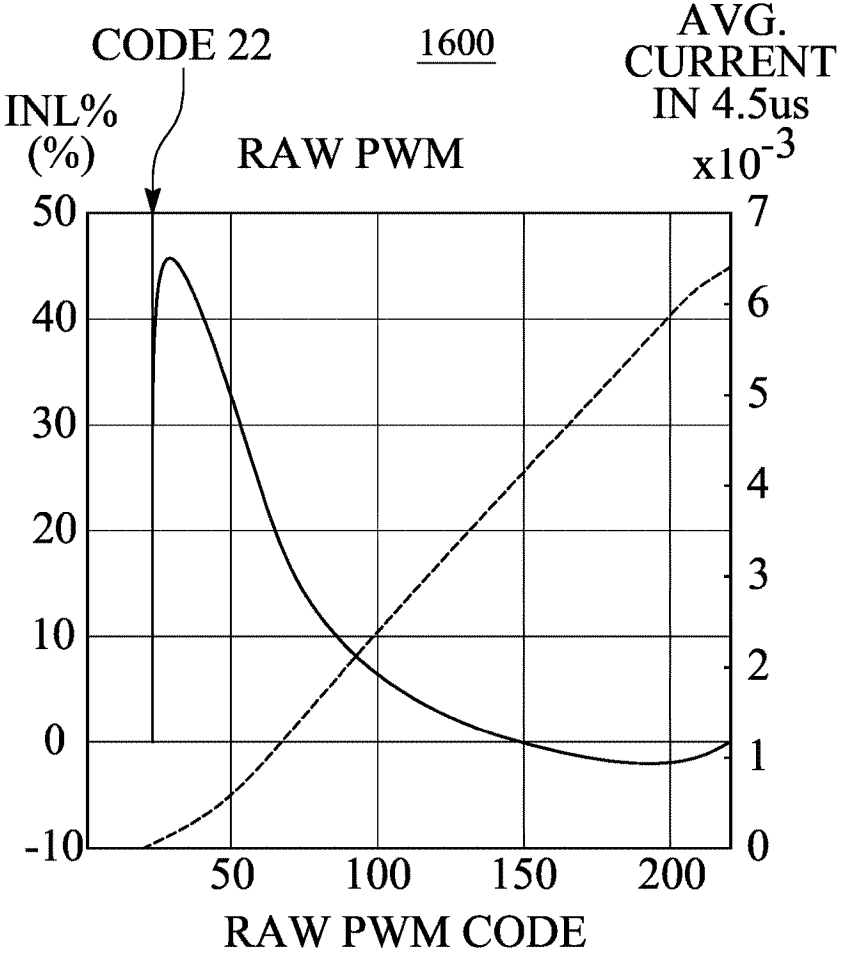

FIG. 16A illustrates linearity versus raw pwm code for a diagram 1600 for a pulse width having a short rise/fall time.

FIG. 16B illustrates an average current versus programmed M-PWM code for a diagram 1610 having an offset setting 1612 to skip a code (e.g., code 22) to skip dead zones in accordance with one embodiment.

Figure 16C:
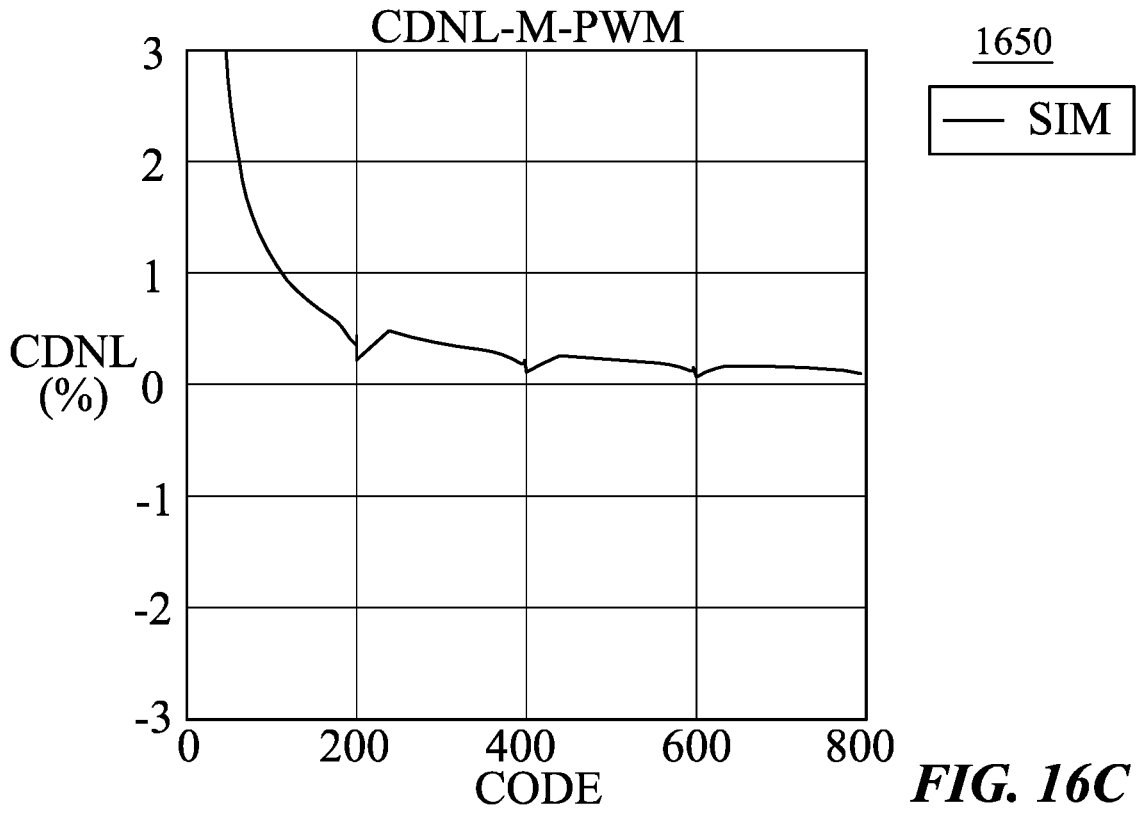

FIG. 16C illustrates CDNL versus M-PWM code.

Figure 16D:
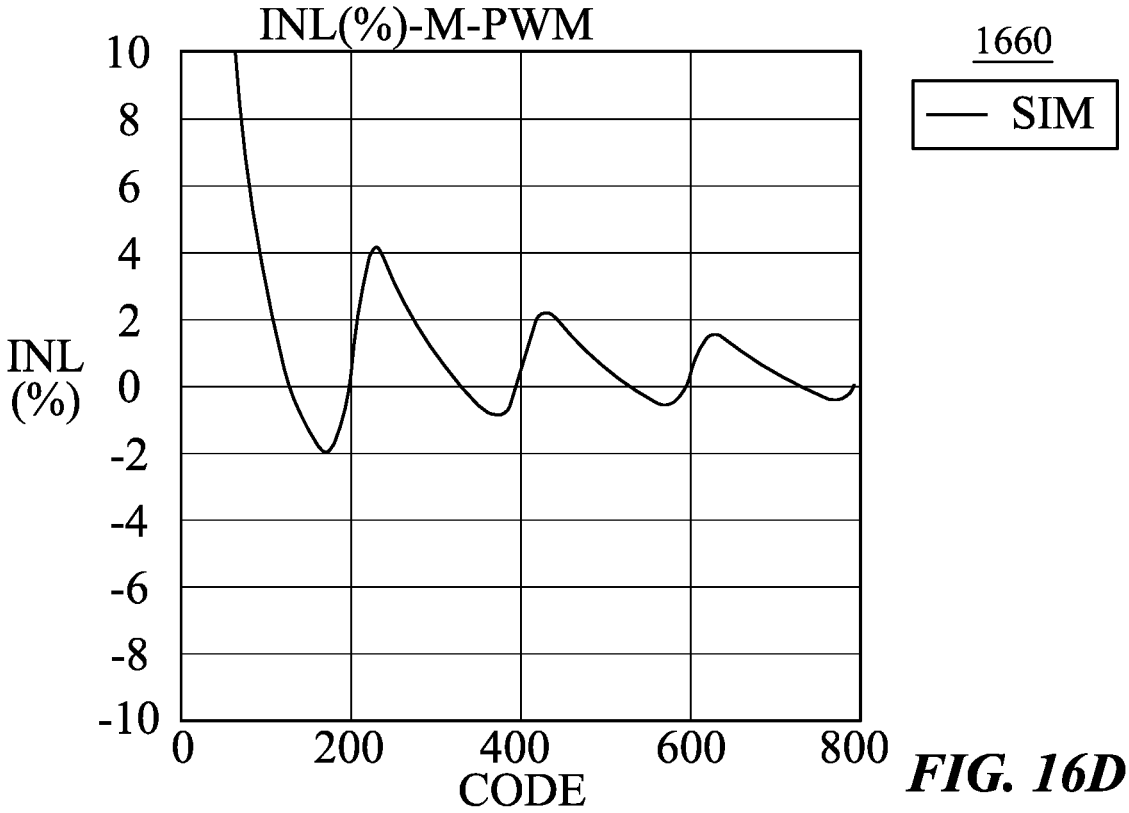

FIG. 16D illustrates linearity versus M-PWM code with offset setting.

Figure 17A:
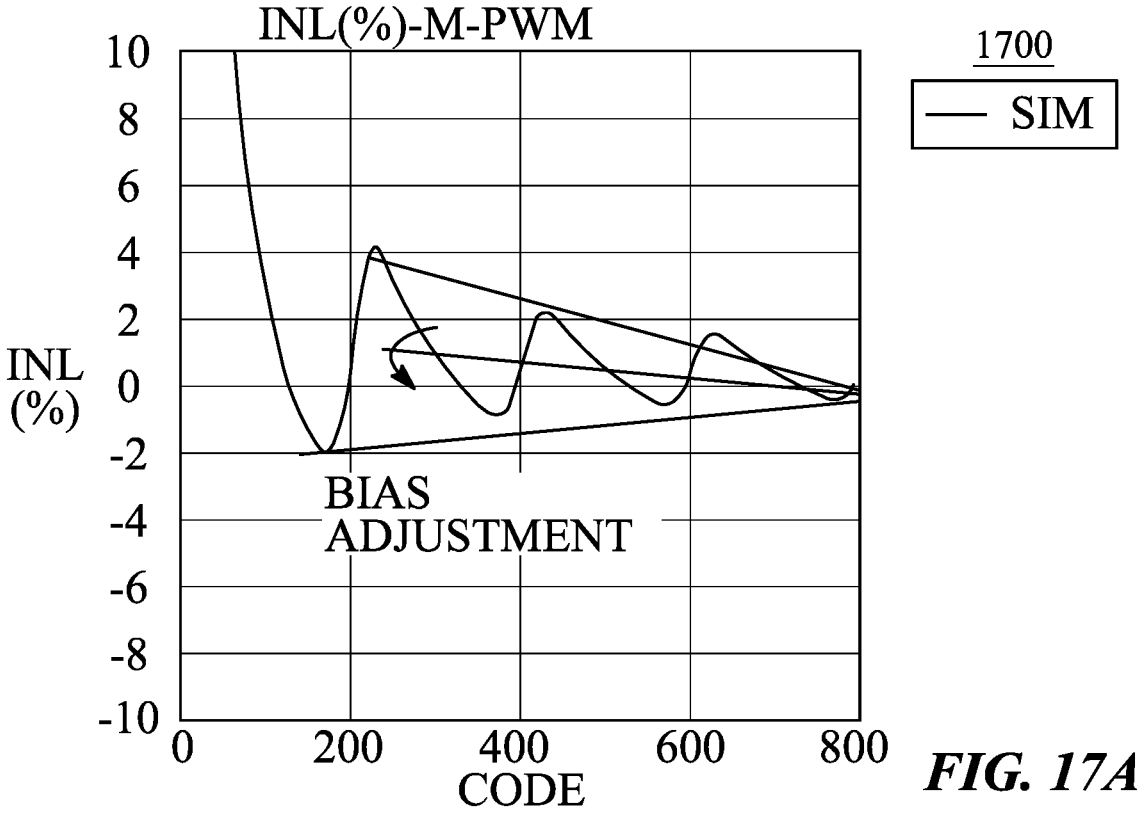

In another embodiment, FIG. 17A illustrates a linearity versus programmed M-PWM code for a diagram 1700 having no bias adjustment in accordance with one embodiment.

Figure 17B:
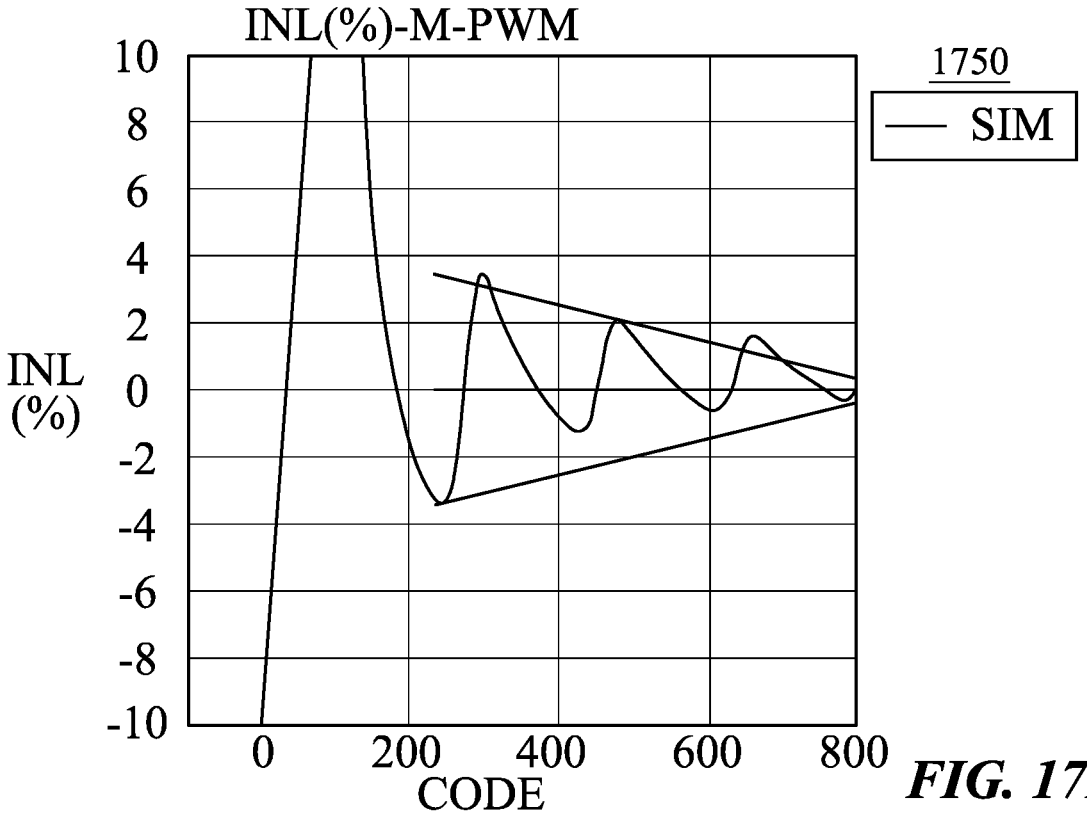

FIG. 17B illustrates a linearity versus programmed M-PWM code for a diagram 1750 having bias adjustment in accordance with one embodiment.

Figure 18:
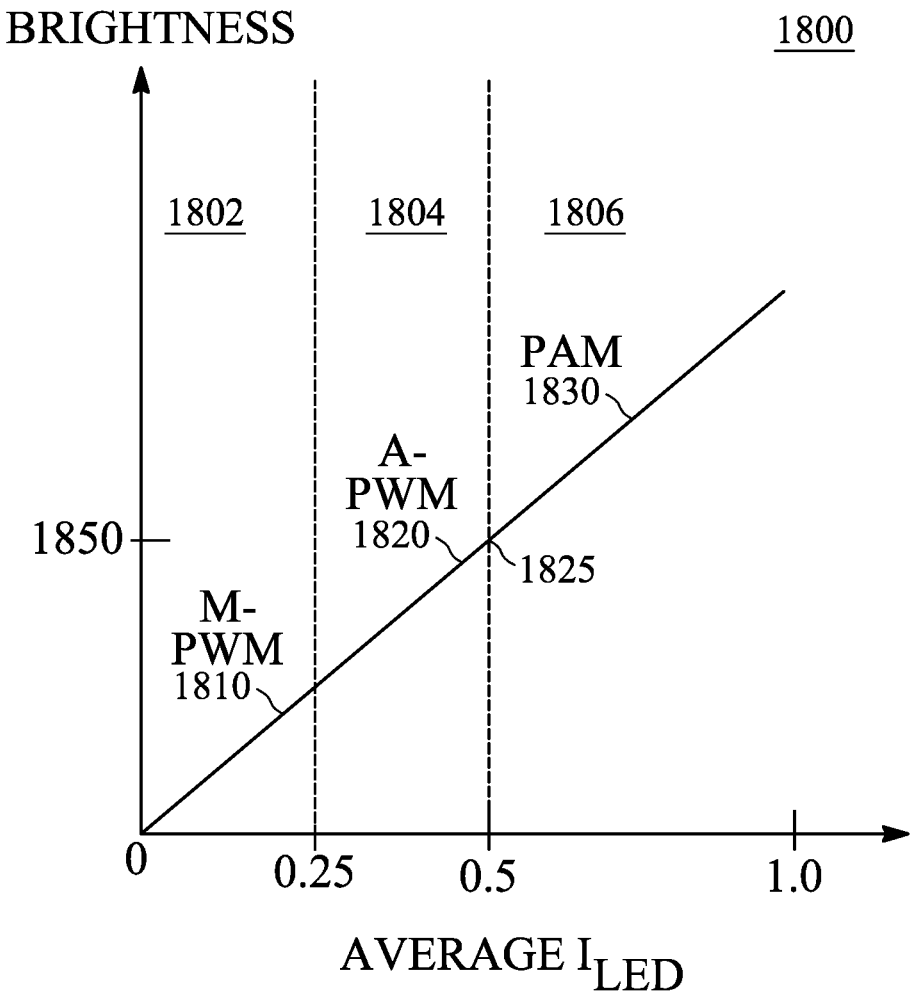

FIG. 18 illustrates a brightness versus LED current diagram 1800 for an electronic device in accordance with one embodiment.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

In one embodiment, systems and methods are disclosed for adaptive pulse width modulation (PWM) and modulo pulse width modulation (PWM). These adaptive PWM and modulo PWM enable faster PWM frequencies and easily adapt to small pulse width requirements that are determined by LED physics. The adaptive PWM and modulo PWM increase usable PWM dynamic range with the same PWM bit depth, substantially improve relative and absolute accuracy/linearity performance of backlight drivers in PWM mode, provide natural x-point calibration for settling errors with no actual calibration required (x is number of pulses per backlight update) for modulo PWM, mitigate acoustic noise problems by using randomized pulse locations that spread the noise and cause reduced ripple on the power converter output, and meet Barten contrast threshold at very low brightness levels (e.g., 0.1 nits) which is not possible with standard PWM and pulse density modulation.

The subject disclosure provides electronic devices such as cellular telephones, media players, tablet computers, laptop computers, set-top boxes, smart watches, wireless access points, and other electronic equipment that include light-emitting diode arrays such as in backlight units of displays. Displays are used to present visual information and status data and/or may be used to gather user input data. A display includes an array of display pixels. Each display pixel may include one or more colored subpixels for displaying color images.

Each display pixel may include a layer of liquid crystals disposed between a pair of electrodes operable to control the orientation of the liquid crystals. Controlling the orientation of the liquid crystals controls the polarization of backlight. This polarization control, in combination with polarizers on opposing sides of the liquid crystal layer, allows light passing into the pixel to be manipulated to selectively block the light or allow the light to pass through the pixel.

The backlight unit includes one or more light-emitting diodes (LEDs) such as one or more strings and/or arrays of light-emitting diodes that generate the backlight for the display. In various configurations, strings of light-emitting diodes may be arranged along one or more edges of a light guide plate that distributes backlight generated by the strings to the LCD unit, or may be arranged to form a two-dimensional array of LEDs.

In a display, control circuitry coupled to the array of display pixels and to the backlight unit receives data for display from system control circuitry of the electronic device and, based on the data for display, generates and provides control signals for the array of display pixels and for the LEDs of the backlight unit.

In some scenarios, the backlight unit generates a constant amount of light for the display pixels and the amount of light that passes through each pixel is solely controlled by the operation of the liquid crystal display pixels. In other scenarios, the amount of light generated by the backlight is dynamically controlled, based on the content to be displayed on the display. In some devices with dynamic backlight control, individual backlight LEDs or groups of backlight LEDs are separately controlled to allow local dimming or brightening of the display to enhance the contrast generated by the LCD pixels. Control circuitry for the LEDs (e.g., for backlight LEDs) may include multiple matrix drivers, each for control of a subarray of an array of LEDs and each synchronized to a synchronization signal from a common controller. The control circuitry for the LEDs may include individual bypass switches for each LED to allow for local dimming at the level of individual LEDs.

Providing local dimming of the backlight LEDs in these disclosed configurations (e.g., using multiple driver circuits each dedicated to a subarray of LEDs and/or using individual LED dimming using bypass switches) allows the backlight circuitry to adjust brightness on a zone-by-zone basis within an image to be displayed. For example, backlight zones may be illuminated only in bright image areas and backlight zones may be dimmed or turned off in dark or black areas of an image. Local dimming in this way helps facilitate high dynamic range (HDR) display of images and improvements in color, contrast, motion-sharpness, and grey level.

Because display backlight units can include, in some implementations, a large number of LEDs (e.g., an array of tens, hundreds, thousands, or millions of LEDs), thermal management for LED backlights and/or other LED arrays can be challenging. The LED drive architectures disclosed herein, in which groups of LEDs and/or individual LEDs are independently controlled, can help reduce the thermal stress and/or energy loss by heat dissipation. Control systems and methods are also disclosed that reduce or minimize the headroom voltage for the backlight, which can also increase system efficiency.

Figure 1:
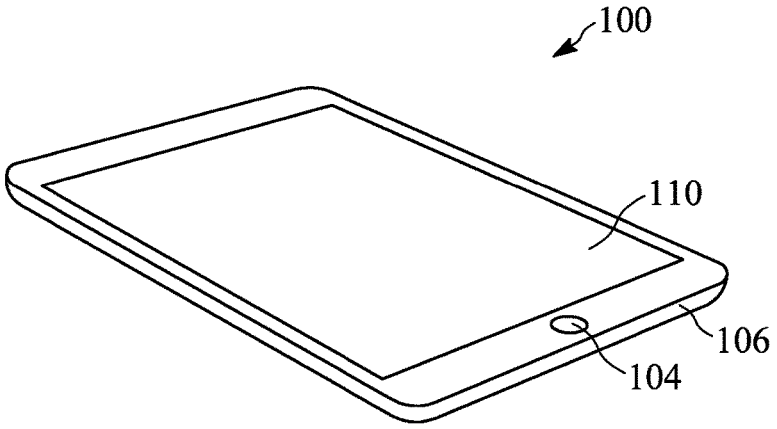
FIG. 1 illustrates a perspective view of an example electronic device having a display in accordance with various aspects of the subject technology.

An illustrative electronic device having a display is shown in FIG. 1. In the example of FIG. 1, device 100 has been implemented using a housing that is sufficiently small to be portable and carried by a user (e.g., device 100 of FIG. 1 may be a handheld electronic device such as a tablet computer or a cellular telephone). As shown in FIG. 1, device 100 includes a display such as display 110 mounted on the front of housing 106. Display 110 may include a display panel having active display pixels in an active area of the display and control circuitry for operating the active display pixels in an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 includes display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using liquid crystal display (LCD) components and a backlight such as two-dimensional array of LEDs that backlight LCD pixels are sometimes described herein as an example. This is, however, merely illustrative. In various implementations, any suitable type of display pixel technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations.

In some implementations, electronic device 100 is provided in the form of a computer integrated into a computer monitor. Display 110 may be mounted on a front surface of housing 106 and a stand may be provided to support housing (e.g., on a desktop).

Figure 2A:
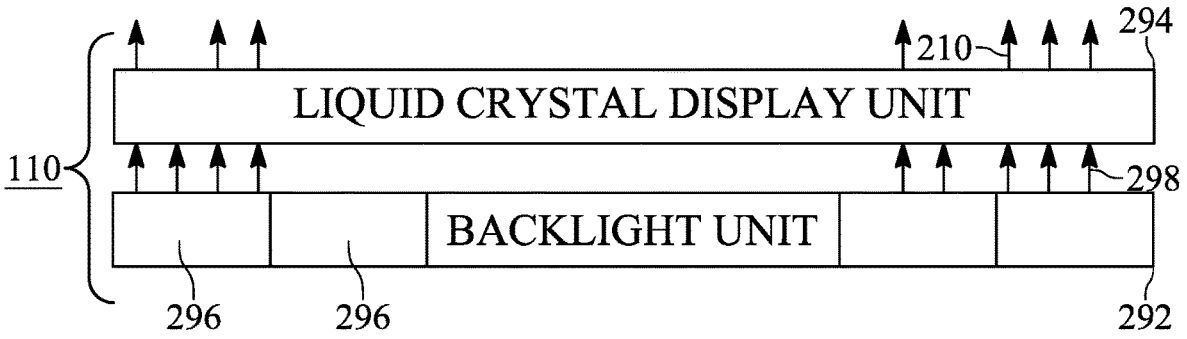
FIG. 2A illustrates a block diagram of a side view of an electronic device display having a backlight unit in accordance with various aspects of the subject technology.

FIG. 2A is a schematic diagram of display 110 in which the display is provided with a liquid crystal display unit 294 and a backlight unit 292. As shown in FIG. 2A, backlight unit 292 generates backlight 298 and emits backlight 298 in the direction of liquid crystal display unit 294. Liquid crystal display unit 294 selectively allows some or all of the backlight 298 to pass through the liquid crystal display pixels therein to generate display light 210 visible to a user. Backlight unit 292 includes one or more subsections 296.

In some implementations, subsections 296 may be elongated subsections that extend horizontally or vertically across some or all of display 110 (e.g., in an edge-lit configuration for backlight unit 292). In other implementations, subsections 296 may be square or other rectilinear subsections (e.g., subarrays of a two-dimensional LED array backlight). Accordingly, subsections 296 may be defined by one or more strings and/or arrays of LEDs disposed in that subsection. Subsections 296 may be controlled individually for local dimming of backlight 298.

Although backlight unit 292 is shown implemented with a liquid crystal display unit, it should be appreciated that a backlight unit such as backlight unit 292 may be implemented in a backlit keyboard, or to illuminate a flash device or otherwise provide illumination for an electronic device.

Figure 2B:
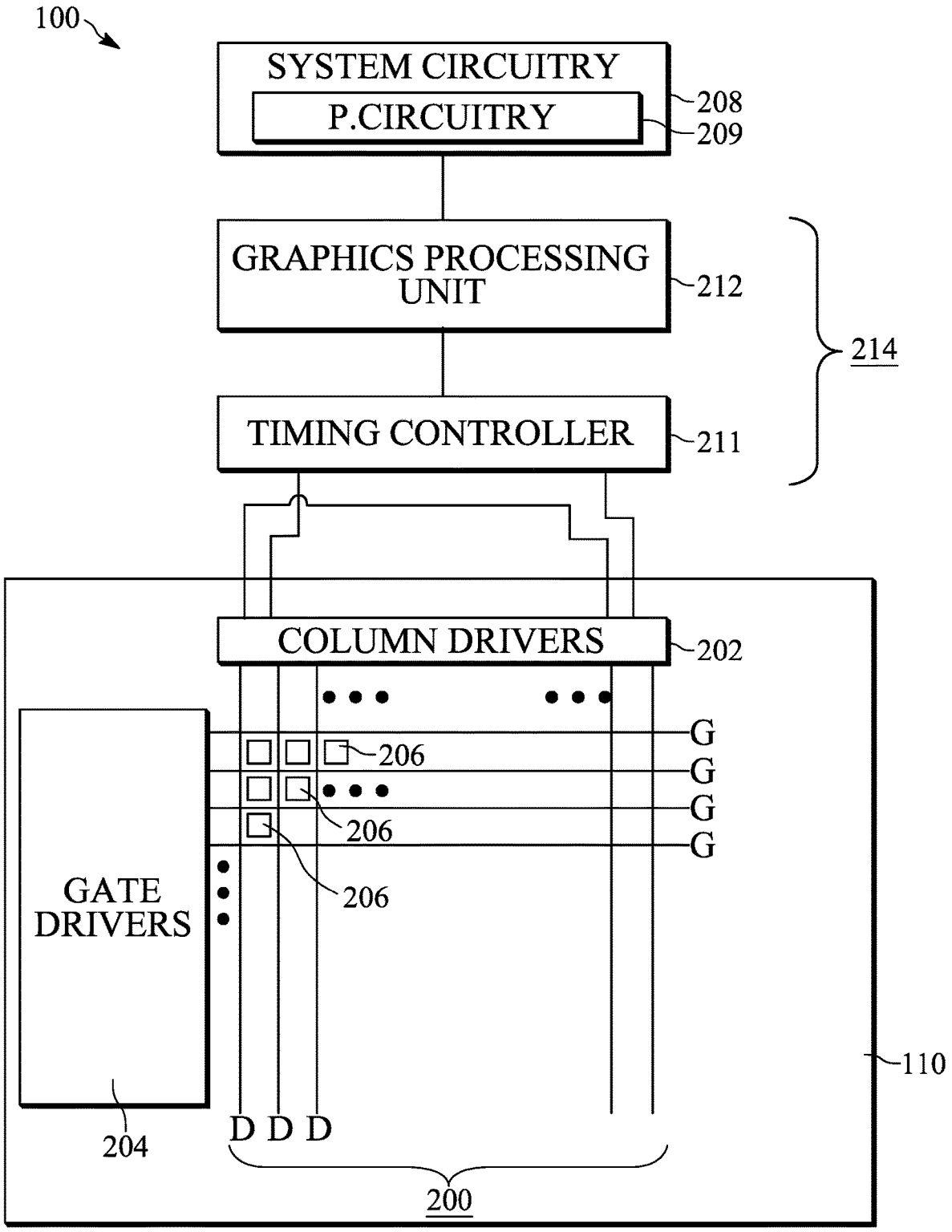
FIG. 2B is a schematic diagram of device 100 showing illustrative circuitry that may be used in displaying images for a user of device 100 on pixel array 200 of display 110.

FIG. 2B is a schematic diagram of device 100 showing illustrative circuitry that may be used in displaying images for a user of device 100 on pixel array 200 of display 110. As shown in FIG. 2B, display 110 may include column driver circuitry such as one or more column driver integrated circuits (CDICs) 202 that drive data signals (analog voltages) onto the data lines D of array 200. Display 110 may also include gate driver circuitry such as one or more gate drivers 204 (e.g., gate driver integrated circuits or GDICs) that drive gate line signals onto gate lines G of array 200.

Using the data lines D and gate lines G, display pixels 206 may be operated to display images on display 110 for a user. In some implementations, CDIC(s) 202 may be mounted on the display substrate with display pixels 206 or attached to the display substrate by a flexible printed circuit or other connecting layer. In some implementations, gate driver circuitry 204 may be implemented using thin-film transistor circuitry on a display substrate such as a glass or plastic display substrate or may be implemented using integrated circuits that are mounted on the display substrate or attached to the display substrate by a flexible printed circuit or other connecting layer. For example, gate driver circuitry 204 may include a plurality of gate driver integrated circuits directly formed on the display panel substrate (e.g., each configured to provide one or more gate signals along one or more corresponding ones of signal gate lines G for one or more corresponding rows of display pixels 206).

Device 100 may include system circuitry 208. System circuitry 208 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in system circuitry 208. Processing circuitry in system circuitry 208 may be used in controlling the operation of device 100. Processing circuitry 209 in system circuitry 208 may sometimes be referred to herein as system circuitry or a system-on-chip (SOC) for device 100.

The processing circuitry 209 may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, system circuitry 208 may be used to run software for device 100, such as interne browsing applications, email applications, media playback applications, operating system functions, software for capturing and processing images, augmented reality (AR) applications, virtual reality (VR) applications, three-dimensional (3D) video applications, etc.

During operation of device 100, system circuitry 208 may generate or receive data that is to be displayed on display 110. This display data may be processed, scaled, modified, and/or provided with processing circuitry 209 to display control circuitry such as graphics processing unit (GPU) 212. For example, display frames, including display pixel values (e.g., each corresponding to a grey level) for display using pixels 206 (e.g., colored subpixels such as red, green, and blue subpixels) may be provided from system circuitry 208 to GPU 212. GPU 212 may process the display frames and provide processed display frames to timing controller integrated circuit 211.

Timing controller 211 provides digital display data (e.g., the digital pixel values each corresponding to a grey level for display) to CDIC(s) 202. Using digital-to-analog converter circuitry, bias circuitry, internal gamma voltage circuitry, level shifter circuitry, shift register circuitry, and/or the like within column driver circuitry 202, column driver circuitry 202 provides corresponding analog output signals on the data lines D running along the columns of display pixels 206 of array 200. Gate drivers 204 such as one or more gate driver integrated circuits (GDICs) on the display panel may receive timing and/or other control signals from timing controller 211.

Graphics processing unit 212 and timing controller 211 may sometimes collectively be referred to herein as display control circuitry 214. Display control circuitry 214 may be used in controlling the operation of display 110. Display control circuitry 214 may sometimes be referred to herein as a display driver, a display controller, a display driver integrated circuit (IC), or a driver IC. Graphics processing unit 212 and timing controller 211 may be formed in a common package (e.g., an SOC package) or may be implemented separately (e.g., as separate integrated circuits). In some implementations, timing controller 211 may be implemented separately as a display driver, a display controller, a display driver integrated circuit (IC), or a driver IC that receives processed display data from graphics processing unit 212. Accordingly, in some implementations, graphics processing unit 212 may be considered to be part of the system circuitry (e.g., together with system circuitry 208) that provides display data to the display control circuitry (e.g., implemented as timing controller 211, gate drivers 204, and/or CDIC(s) 202). Although a single gate line G and a single data line D for each pixel 206 are illustrated in FIG. 2B, this is merely illustrative and one or more additional row-wise and/or column-wise control lines may be coupled to each pixel 206 in various implementations.

Figure 3:
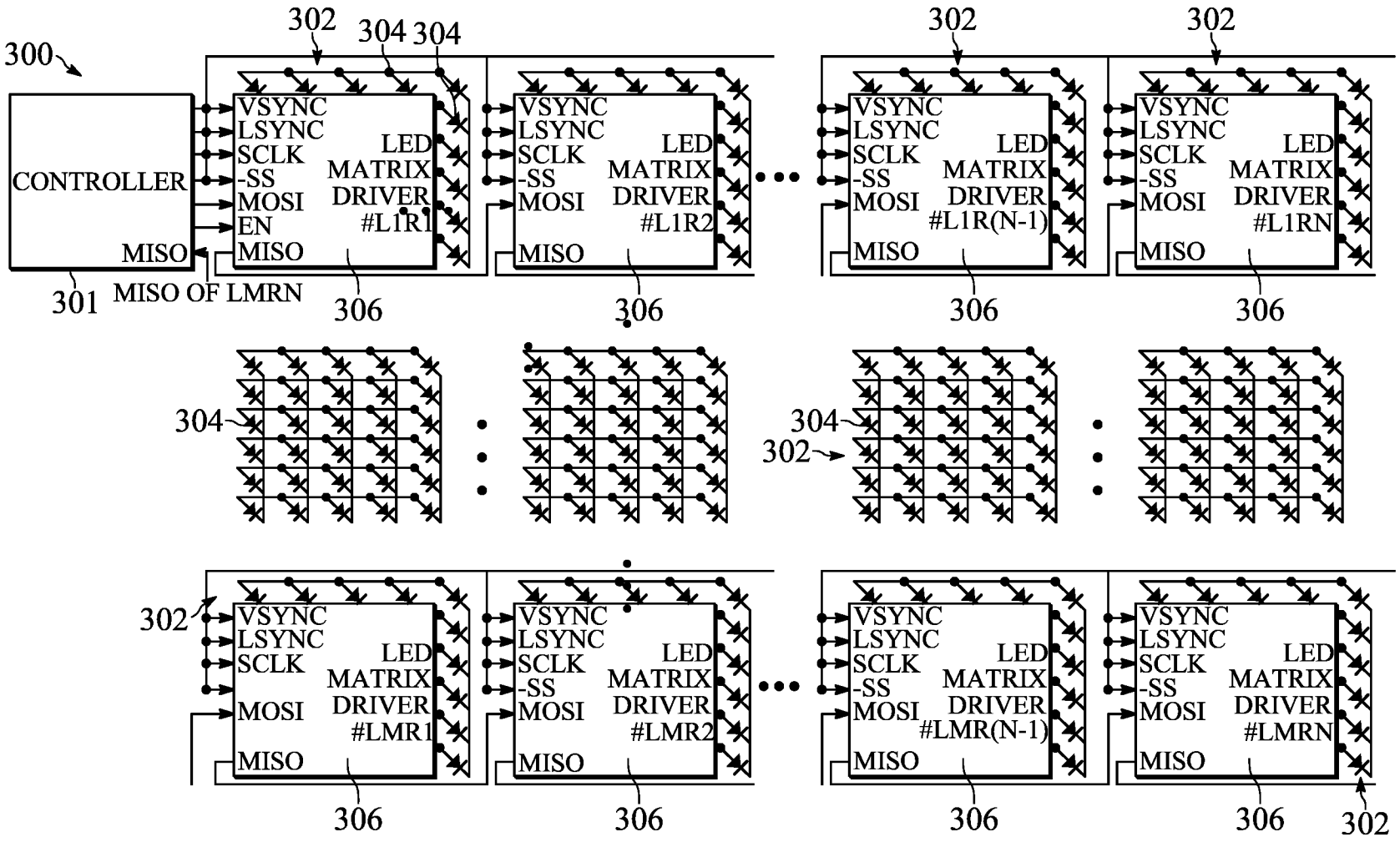
FIG. 3 shows a schematic diagram of exemplary display circuitry including control circuitry 300 that may be implemented in backlight unit or other LED lighting devices.

FIG. 3 shows a schematic diagram of exemplary display circuitry including control circuitry 300 that may be implemented in backlight unit or other LED lighting devices. In the example of FIG. 3, control circuitry 300 includes multiple subarrays 302 of LEDs 304 that, in combination, form a two-dimensional array of LEDs. Each subarray 302 may include one or more strings of LEDs that each include multiple LEDs 304 in series. Subarrays 302 may each include multiple strings of LEDs that are coupled, in parallel, between a common supply voltage source and a current controller for that string.

Each subarray 302 includes a dedicated matrix driver circuit 306 (sometimes referred to simply as driver circuits for convenience) that operates the LEDs 304 in that array. Each matrix driver circuit 306 operates the LEDs 304 of its associated array 302 to provide local dimming of the entire array or local dimming of individual strings of LEDs in that array. Each matrix driver circuit 306 provides local dimming of LEDs 304, which may enhance the relative brightness and darkness of display content controlled by LCD unit 294. Accordingly, matrix driver circuitry 306 may operate the LEDs of their associated arrays 304 based, at least in part, on the content being displayed using LCD unit 294.

In order to operate the LEDs of an associated array 304 based, at least in part, on the content being displayed using LCD unit 294, each matrix driver circuitry 306 receives one or more control signals from a common controller 301. As shown in the example of FIG. 3, each matrix driver 306 receives the same vertical synchronization (VSYNC), line synchronization (LSYNC), serial clock (SCLK) and slave select (-SS) signal from controller 301. The VSYNC, LSYNC, SCLK and/or -SS signals may be signals used to operate the LCD pixels of LCD unit 294 as would be understood by one skilled in the art. For example, the VSYNC signal may be provided by controller 301 to indicate each display refresh or each display frame to be displayed using LCD pixels of the LCD unit. The LSYNC signal may be provided by controller 301 to signal the start of operation of each pixel row.

Controller 301 may be used to provide control signals such as the VSYNC and LSYNC signals, and/or other control signals, to both backlight unit 292 and LCD unit 294 or controller 301 may be a dedicated backlight control unit that receives the VSYNC, LSYNC, and/or other control signals from another display controller associated with LCD unit 294.

Each matrix driver 306 may update the brightness of its associated array 302 (e.g., the entire array or a subset of the array) based on the commonly received VSYNC signal (e.g., the brightness may be updated upon receipt of the rising edge of the VSYNC signal). In some implementations, each matrix driver 306 may include a programmable delay to set the relative timings of the various LED array updates based on the rising edge of the common VSYNC signal.

A first one of matrix drivers 306 (labeled LED Matrix Driver #L1R1 in FIG. 3) also receives and an enable signal (EN) and a Master-Out-Slave-In signal (MOSI) from common controller 301. LED Matrix Driver #L1R1 provides a Master-In-Slave-Out signal (MISO) to a next one of matrix drivers 306 (labeled LED Matrix Driver #L1R2 in FIG. 3), and so forth until a last one of matrix drivers 306 (labeled LED Matrix Driver #LMRN in FIG. 3). LED Matrix Driver #LMRN provides a MISO signal back to controller 301.

In some implementations, each matrix driver 306 may be an integrated circuit having an internal clock. However, due to process variations in manufacturing integrated circuits, an array of matrix drivers 306 each having its own clock can be problematic in that the operation of the various LED arrays 302 can be out of sync by as much as, for example, 10 percent. In order to ensure that the local dimming of LEDs 304 of various arrays 302 are synchronized to the associated content to be displayed, matrix drivers 306 are operated using a common (e.g., master) clock signal SCLK with synchronization of the various matrix drivers using the common LSYNC signal.

Figure 4:
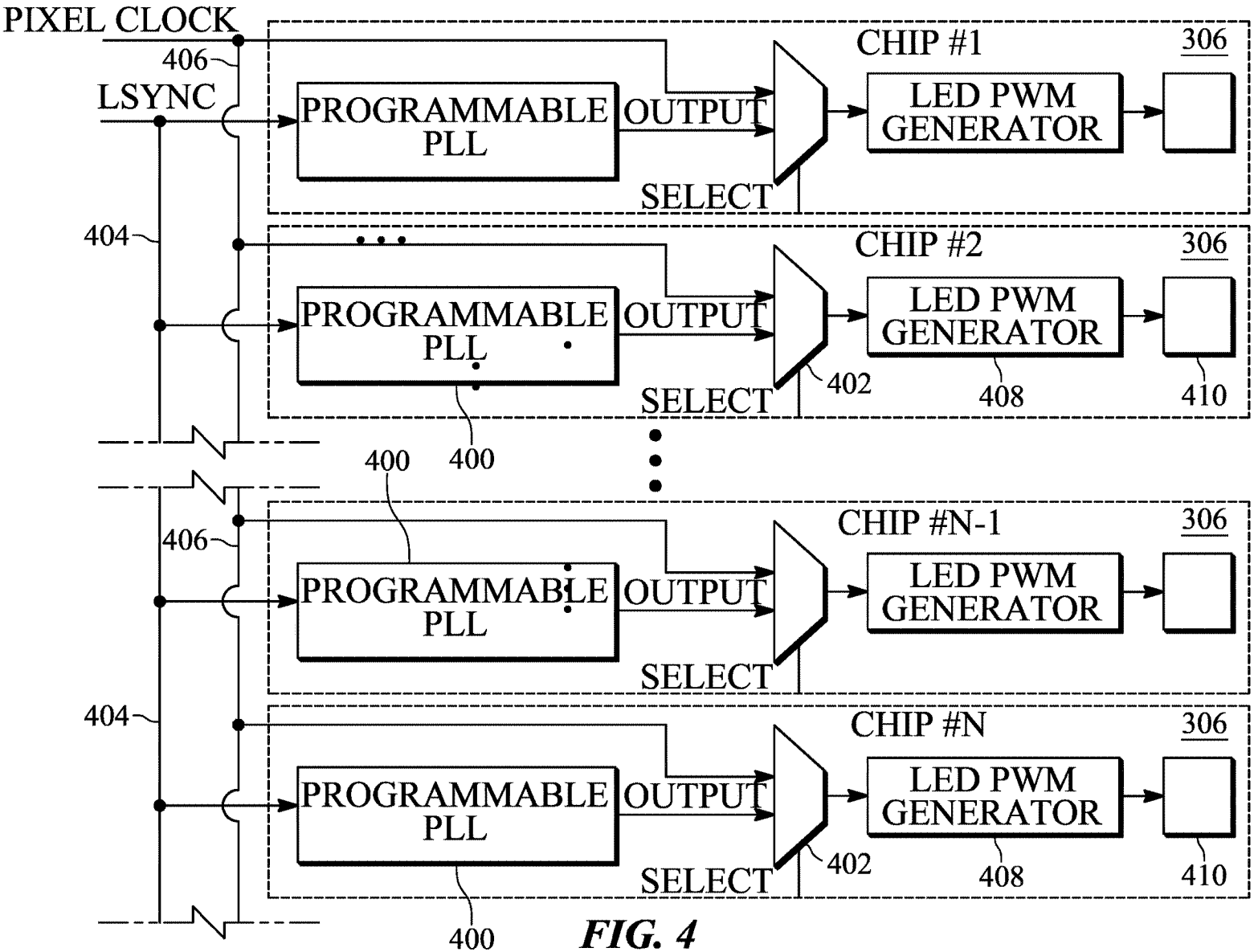
FIG. 4 shows a schematic representation of exemplary circuitry of matrix drivers 306.

FIG. 4 shows a schematic representation of exemplary circuitry of matrix drivers 306. In the example of FIG. 4, each matrix driver 306 includes a programmable phase lock loop (PLL) 400. Each PLL 400 receives the common LSYNC signal along a path 404 from common controller 301 of FIG. 3 and generates a synchronization output signal which is provided to a multiplexer 402. Each multiplexer 402 also receives the clock signal (labeled Pixel Clock in FIG. 4 and SCLK in FIG. 3) along a path 406 from common controller 301.

Based on a selection signal "Select", each multiplexer 402 generates a driver clock signal for its associated matrix driver 306, the driver clock signal geared from the LSYNC synchronized PLL signal and/or the clock signal. The selected driver clock signal is provided to a pulse-width modulation (PWM) generator 408 that generates a PWM signal, based on the provided driver clock signal, for use in controlling the brightness of the LEDs (e.g., in one or more strings) in the array 302 associated with that matrix driver 306.

The PWM signal from the PWM generator 408 of each matrix driver 306 is provided to LED control circuitry 410 of that matrix driver 306 for controlling the brightness of LEDs 304 of that array 302 associated with that matrix driver 306. LED control circuitry 410 of each matrix driver 306 may include, for example, a DC/DC converter or switching converter (e.g., implemented as a buck converter, a boost converter, or an inverter) for providing a supply voltage to a first end of each LED string in the associated array 302. The supply voltage generated by LED control circuitry 410 is based on the PWM signal provided by the associated LED PWM generator 408.

LED control circuitry 410 of each matrix driver 306 may also include additional circuitry such as a current driver circuitry or controlling current at a second end of each string of LEDs, may include headroom voltage control circuitry, and/or may include individual LED switching circuitry (e.g., in implementations in which each LED in a string is provided with a bypass switch as described in further detail hereinafter).

Each matrix driver 306 may also include headroom voltage control circuitry that provides feedback control of LED arrays 302 to help reduce energy loss by reducing or minimizing residual voltages at the end of each LED string.

For high PWM frequencies (e.g., fpwm>200 kHz, fpwm>100 kHz), full PWM dynamic range cannot be used due to pulses being too short (e.g., <100 ns) causing more distortion or possibly causing no illumination of an LED. Pulse density modulation (removing one pulse for each step) cannot be used without exceeding Barten contrast threshold. Adaptive PWM can be used for smaller step sizes (removing one pulse and slightly increasing pulse width of other pulses for each step) for high PWM frequencies to improve PWM dynamic range.

For low brightness levels, adaptive PWM intelligently combines standard PWM with pulse density modulation (PDM) without performance degradation. Adaptive PWM changes the pulse width of all pulses at each step. Once a minimum pulse width that can illuminate an LED is reached, the adaptive PWM drops one pulse while increasing pulse widths of all others to compensate for the reduction in energy from removing the one pulse.

Figure 5:
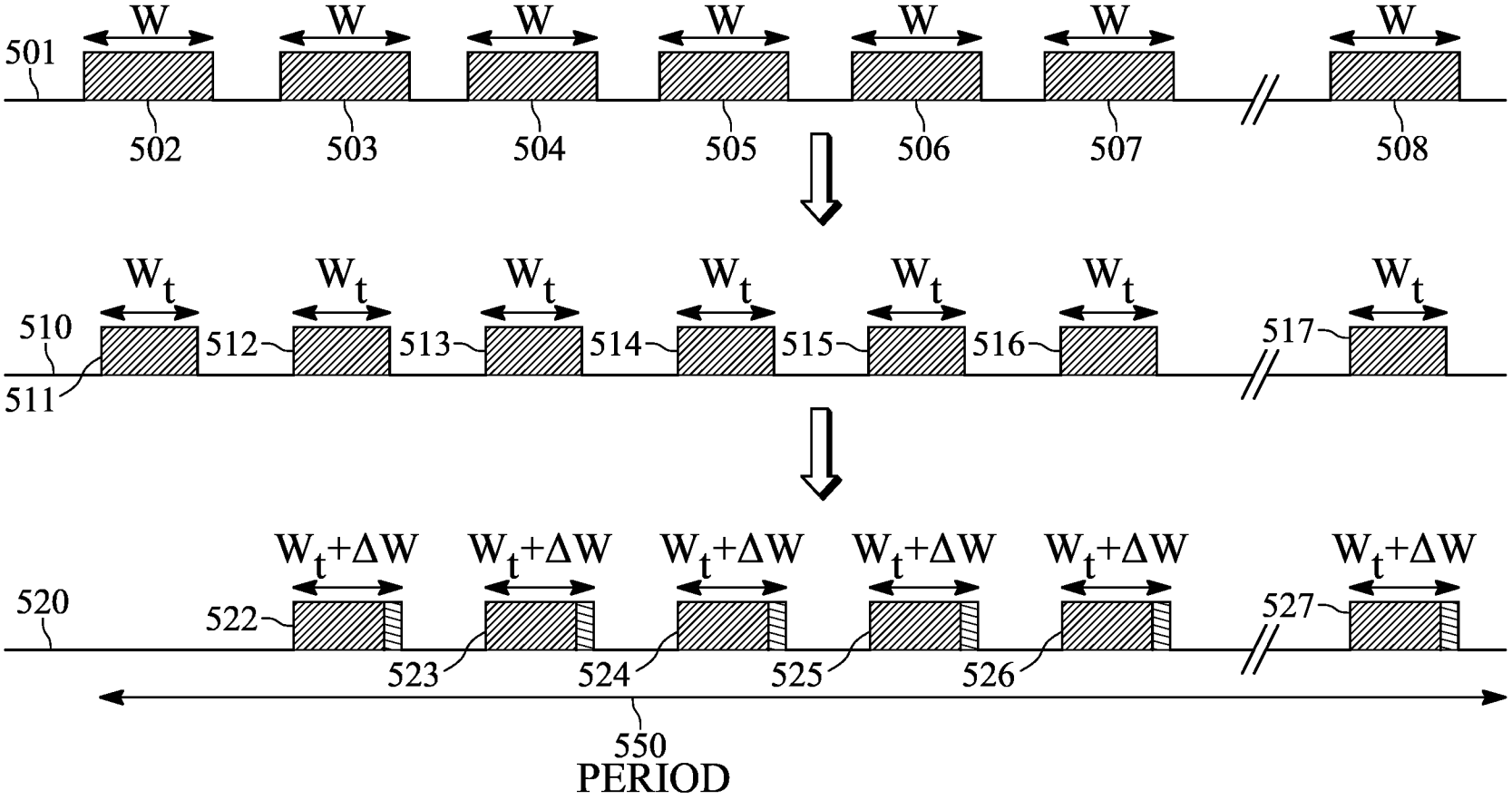
FIG. 5 illustrates adaptive PWM signals in accordance with one embodiment.

FIG. 5 illustrates adaptive PWM signals in accordance with one embodiment. An adaptive PWM signal is designed with each pulse 502-508 of a signal 501 having a pulse width W and the pulse width being reduced until reaching a threshold pulse width Wt (e.g., minimum allowable pulse width) of signal 510, then one pulse is removed from the pulses 511-517. Optionally, a pulse width of each of the other remaining pulses is increased by a delta width to compensate for a reduction in energy from removing the one pulse if non-linearity remains unchanged or does not worsen based on the addition of the delta width to each remaining pulse. The adaptive PWM signal 520 is optional and may be generated for cases when non-linearity remains unchanged or does not become worse due to the addition of the delta width.

A PWM signal 510 includes pulses 511-517 each having a width Wt and the same amplitude. An optional adaptive PWM signal 520 includes pulses 522-527 each having a width Wt+delta W and a time period 550. The pulses of the PWM signal 510 have the same or slightly less energy of the pulses of the adaptive PWM signal 520 that has 1 fewer pulse but each pulse has a wider width, Wt+delta W. The adaptive PWM signal 520 can operate for high PWM frequencies due to having fewer pulses than PWM signal 510 without degrading performance due to narrower pulses.

In another embodiment, an adaptive pulse amplitude modulation that removes 1 pulse and slightly increases a pulse amplitude for all remaining pulses would be beneficial for improving dynamic range.

In another embodiment, a modulo PWM algorithm would generate a wider pulse width for 1 pulse (e.g., 1 pulse out of 84 pulses for a display frame update) and keep other pulses the same to reduce distortion.

An integrated radiation current generates luminance. A settling error for luminance of LEDs is inversely proportional to time (e.g., pixel settling proportional to log (time)). Thus, it is desirable to keep pulse widths as long as possible. A modulo PWM signal can be similar to the signal 510 of FIG. 5, except 1 pulse width will be modified in order to keep pulse widths as long as possible. In one example, for an update to a display frame, 84 pulses are utilized with 1 pulse having a modified width based on the modulo PWM of FIG. 6.

Figure 6:
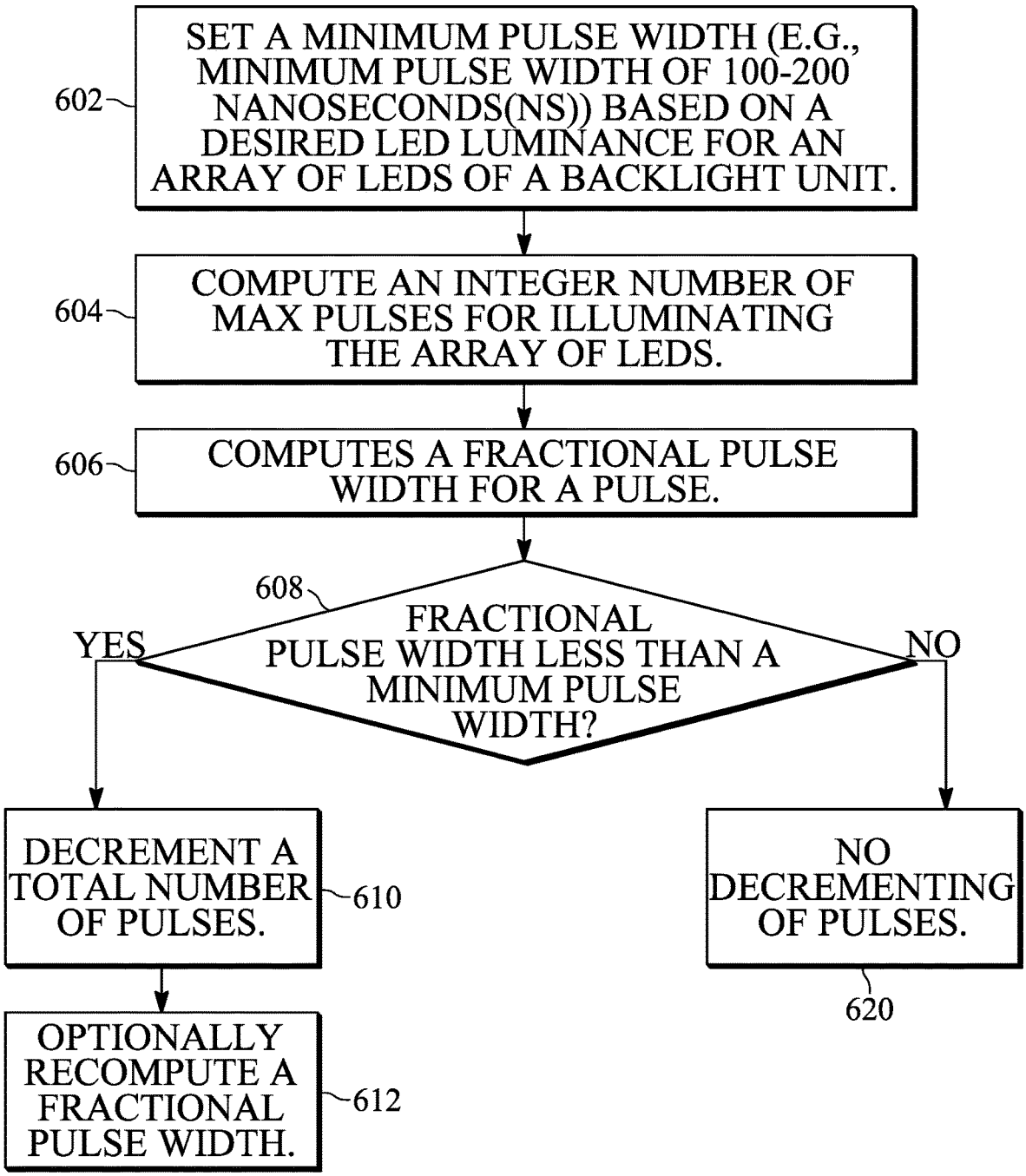
FIG. 6 illustrates an example method of modulo PWM in accordance with one embodiment.

For explanatory purposes, the blocks of the example method of modulo PWM of FIG. 6 are described herein as occurring in series, or linearly. However, multiple blocks of the example method of FIG. 6 may occur in parallel. In addition, the blocks of the example method of FIG. 6 need not be performed in the order shown and/or one or more of the blocks of the example method of FIG. 6 need not be performed. A backlight unit, display circuitry, control circuitry, matrix drivers, PWM generator, processing circuitry (e.g., processor executing instructions for an algorithm) may perform one or more of the operations of FIG. 6. This circuitry may include hardware (circuitry, dedicated logic, etc.), software (such as is run on a general purpose computer system or a dedicated machine or a device), or a combination of both.

The modulo PWM changes the pulse width of one pulse for each step, row, or per each line of a pulse train. Once the width of the modified pulse reaches a minimum allowed pulse width, the modulo PWM drops that pulse and adds this energy to another pulse. In the depicted example flow diagram, at operation 602, the method sets a minimum pulse width (e.g., minimum pulse width of 100-200 nanoseconds (ns)) based on a desired LED luminance for an array of LEDs of a backlight unit.

At operation 604, the method computes an integer number of max pulses for each row for illuminating the array of LEDs. At operation 606, the method computes a fractional pulse width for a pulse for each row. The fractional pulse width may have less energy than a minimum energy level for illuminating an LED. At operation 608, the method determines whether a fractional pulse width is less than a minimum pulse width for illuminating an LED. If so, at operation 610, the method decrements a total number of pulses for a row. At operation 612, the method can optionally recompute a fractional pulse width for a row.

If the fractional pulse width is equal or greater than a minimum pulse width at operation 608, then no decrementing of pulses is needed at operation 620.

Examples of pulses for modulo PWM are illustrated in FIGS. 7A and 7B in accordance with one embodiment. FIG. 7A illustrates PWM code versus time for 4 pulses 710, 711, 712, and 713 with 4-bit PWM. The lightly shaded regions represent a full pulse width and the dark shaded regions represent a partial or fractional pulse width. In this example, one of the four pulses has a fractional pulse width for each row or line. The bars labeled as charge transferred 720 indicate an amount of charge transferred to LEDs for illuminating the LEDs.

FIG. 7B illustrates PWM code versus time for 4 pulses 730, 731, 732, and 733 having randomized pulse locations. The lightly shaded regions represent a full pulse width and the dark shaded regions represent a partial or fractional pulse width. In this example, one of the four pulses has a fractional pulse width for each row or line. The bars labeled as charge transferred 780 indicate an amount of charge transferred to LEDs for illuminating the LEDs. The charge transferred 780 is the same as the charge transferred 720. The fractional pulse widths having been randomized in FIG. 7B rather than occurring after the full pulse widths of FIG. 7A. The randomized pulse locations mitigate acoustic noise problems by spreading the noise and cause reduced ripple on a power converter output of a PWM generator as illustrated in FIG. 8D. In one example, the ordered pulses exceed a 50 mV specification for the power converter output while the randomized pulses are safely within the 50 mV specification.

The adaptive PWM and modulo PWM are beneficial for reducing luminance settling error. In one example, an electrical specification is designed for a threshold contrast %. A 50 microsecond (us) pulse width, 11b PWM, 3b dither (A-PWM) for adaptive PWM and a 5 us pulse width, 8b PWM, 6b dither (A-PWM) for adaptive PWM both exceed the threshold contrast % for the electrical specification for lower luminance values (e.g., less than 1 nits). However, 3 us pulse width, 8b PWM, 84 PDM (M-PWM) for modulo PWM and 5 us pulse width, 8b PWM, 84 PDM (M-PWM) for the modulo PWM have contrast % that is within the electrical specification for threshold contrast % as illustrated in FIG. 8A in one example. FIG. 8A also illustrates a Barten reference curve, 0.3% at 2000 NITS.

In another example, an electrical specification is designed with a linearity (INL %) parameter. FIG. 8B illustrates linearity for adaptive and modulo PWM pulses in one example. A 50 microsecond (us) pulse width, 11b PWM, 3b dither (A-PWM) for adaptive PWM and a 5 us pulse width, 8b PWM, 6b dither (A-PWM) for adaptive PWM both exceed the linearity % for the electrical specification. However, 3 us pulse width, 8b PWM and 84 PDM (M-PWM) and 5 us pulse width, 8b PWM and 84 PDM (M-PWM) for the modulo PWM have linearity % that is within the electrical specification.

In another example, calibrations points can be added to add zeros to the linearity curve of FIG. 8B, which has a single-point calibration at 40 nits. FIG. 8C illustrates multiple calibrations points (e.g., 0.4 nit, 1.5 nit, 40 nit) to improve linearity for CAL 50 us pulse width, 11b PWM, 3b dither (A-PWM) for adaptive PWM and CAL 5 us pulse width, 8b PWM, 6b dither (A-PWM) for adaptive PWM based on additional zeros at 0.4 nit and 1.5 nit. However, 3 us pulse width, 8b PWM and 84 PDM (M-PWM) for modulo PWM and 5 us pulse width, 8b PWM and 84 PDM (M-PWM) for the modulo PWM behave as an 84 point calibration for settling errors without actually performing any calibration. FIG. 8C shows how M-PWM has zeros that result in natural 84-point calibration.

Modulo PWM can have different variations to increase dynamic range. A first example may include a first amplitude of pulses, a first pulse width, and a first frequency (e.g., 20 kHz). A second example may include a second reduced amplitude of pulses, the first pulse width, and the first frequency (e.g., 20 kHz). A third example may include the second reduced amplitude of pulses, a second reduced pulse width, and a second frequency (e.g., greater than 20 kHz). A fourth example may include the second reduced amplitude of pulses, the second reduced pulse width, the second frequency (e.g., greater than 20 kHz), and reducing a total number of pulses (e.g., decrementing). A fifth example may include the second reduced amplitude of pulses, the second reduced pulse width, the second frequency (e.g., greater than 20 kHz), and a third reduced pulse width for one pulse.

FIG. 9 illustrates pulse conditions for modulo PWM 900 in accordance with one embodiment. FIG. 9 illustrates pulses within PWM windows for different codes that correspond to different luminance levels on a vertical axis and time on a horizontal axis. In one example, a maximum pulse width=7 and a minimum pulse width=2. The modulo PWM method 900 reserves a portion of the PWM window for pulse growth.

FIG. 10 illustrates pulse conditions for modulo PWM in accordance with another embodiment. FIG. 10 illustrates pulses within PWM windows for different codes that correspond to different luminance levels on a vertical axis and time on a horizontal axis. The modulo PWM method 1000 uses nearly all or all of the available PWM window. As PWM reduces, the method 1000 reduces a last pulse (L) and then reduces (L-1) pulse when last pulse (L) hits min width. When pulse L-1 has minimum width available, the method proceeds to maximum width for L-1 and pulse L is dropped at code 21. Method 1000 therefore covers a wider range of luminance (e.g., 1-28 in this example) compared to method 900 that has a smaller range of luminance levels (e.g., 1-24).

In modulo PWM, if the pulses are all placed together as described in the method 1000, this method can cause Flicker and Periodic load variation, which causes audible effects or voltage droops. To mitigate these issues, the pulses are spread around. The diagrams 1100 and 1150 of FIGS. 11A and 11B show two methods to spread pulses. Each row in these diagrams represents a pulse train that continuously repeats.

Uniform distribution 1100 has an issue if the number of pulses changes slowly—e.g. if the number of pulses is 2 for some time, then becomes 3, there is a visible difference due to the phase shift in the energy distribution.

In Fixed Placement 1150 as the number of pulses increases, the pre-existing pulses are left unchanged and a new pulse is grown at a location to maximize distance from existing pulses (after accounting for the fact that the pattern repeats). In Fixed placement, if a shift occurs between 2 and 3 pulses, the average phase moves very little compared to the "Uniform Distribution" and there is less chance of a visible artifact.

In another embodiment, an enhanced modulo PWM (EM-PWM) partitions every consecutive N self-refresh cycles into one group. FIG. 12 illustrates a timing diagram for pulse conditions and partitioning for enhanced modulo PWM in accordance with another embodiment. The timing diagram 1200 includes a display signal 1210 for a LCD scan 1212 (e.g., 90 Hz scan rate) and a LCD scan 1214 (e.g., 120 Hz scan rate), a clock signal 1220 (e.g., FSYNC signal 1220), a LED backlight signal 1230 that includes backlight updates 1231-1234 (e.g., 240 Hz update rate) and partial backlight update 1235. The EM-PWM 1240 signal partitions the backlight updates 1231-1235 into groups 1241-1254 as illustrated in FIG. 12. A pulse train signal 1260 includes the pulses of groups 1241-1243.

In one example, the backlight update 1231 includes 15 self-refresh cycles, N=5 consecutive self-refresh cycles, and thus backlight update 1231 is partitioned into groups 1241-1243. N=1 is the modulo PWM example of FIG. 6. A number of refresh cycles within one backlight update needs to be divisible by N in order to have uniform spreading of pulses between groups.

The EM-PWM has improved contrast threshold within an electrical specification, perfect synchronization to the LCD scan, reduced ripple on a power supply, better acoustic noise performance, and enhanced flicker performance in comparison to modulo PWM that has no partitioning.

The EM-PWM will also have increased adaptive sync granularity (e.g., if 84 total pulses in pulse train, 14 groups, N=6, then have 300 us adaptive sync granularity).

Low amplitude pulse widths with sloping do not illuminate LEDs and create PWM non-linearity. Longer rise/fall times for pulses introduces non-linearity, which violates an electrical specification. Average luminance error has a small negative bias resulting in reduced margins. These issues cause out of electrical specification for PWM contrast DNL (cDNL) and PWM Linearity (INL) requirements.

In other embodiments, PWM offset is added to each pulse for improved linearity and PWM bias can also be added to reduce error bias.

FIG. 13A illustrates an output luminance versus programmed luminance diagram 1300 having uncorrected delay with a dead-zone due to longer rise/fall times (e.g., 12.5 ns, 250 ns, 450 ns rise/fall times). The output luminance does not respond to programmed luminance codes in the dead-zone. Diagram 1300 shows programmed luminance on a scale of 0 to 1 nits. Diagram 1305 shows programmed luminance for a full PWM range of 0 to 40 nits. FIG. 13B illustrates a threshold contrast diagram 1310 with delay effects for 12.5 ns, 250 ns, and 450 ns rise/fall signals. The contrast is above a Barten reference for lower luminance values. FIG. 13C illustrates a linearity diagram 1320 with delay effects for 12.5 ns, 250 ns, and 450 ns rise/fall signals. The linearity is outside of an electrical specification due to the delay effects.

FIG. 13D illustrates an output luminance versus programmed luminance diagram 1350 having corrected delay for 12.5 ns, 250 ns, and 450 ns rise/fall signals with no dead-zone due to a PWM offset. FIG. 13E illustrates a threshold contrast diagram 1360 with the threshold contrast having corrected delay for 12.5 ns, 250 ns, and 450 ns rise/fall signals. These signals are within an electrical specification due to the PWM offset. FIG. 13F illustrates a linearity diagram 1370 having corrected delay for 12.5 ns, 250 ns, and 450 ns rise/fall signals and these signals being within an electrical specification due to the PWM offset.

FIG. 14A illustrates how an input PWM code 1410 is changed with processing circuitry to be an effective output PWM code 1420 that includes the shaded bits for the PWM offset. In one example, a fixed 5-bit width is added to all pulses as illustrated in FIG. 14B. Original pulse train 1510 is modified to have PWM offset 1520 to generate PWM pulse train 1530. The PWM offset can be a positive or negative offset.

FIG. 15A illustrates an uncorrected bias luminance error versus programmed luminance diagram 1500 for shorter rise/fall times. FIG. 15B illustrates a corrected bias luminance error versus programmed luminance diagram 1510 for shorter rise/fall times in accordance with one embodiment. The bias luminance error has been corrected using additional bits (e.g., 2 least significant bits) to shift the error curves to be centered at 0.000 instead of having a bias 1510. The data point 1540 of FIG. 15B has been shifted to have reduced error and also good linearity as illustrated in the diagram 1530 of FIG. 15D. FIG. 15C illustrates a threshold contrast diagram 1520 with the threshold contrast being within an electrical specification due to delay correction from PWM offset and bias correction based on the biasing with the biasing bits. FIG. 15C can be compared with FIG. 13E to visualize the improved threshold contrast based on the biasing. FIG. 15D illustrates linearity with corrected delay and corrected bias versus luminance for shorter rise/fall times in accordance with one embodiment. FIG. 15D can be compared with FIG. 13F to visualize the improved linearity based on the biasing.

FIG. 15E illustrates a block diagram of PWM biasing circuitry for adding biasing bits to a data buffer in accordance with one embodiment. PWM biasing circuitry 1570 includes an input buffer 1580 to buffer input PWM data (e.g., data in still picture interchange file format), an adder to add biasing bits from bias circuitry 1590 to the input PWM data to generate modified PWM data that is buffered in LED data buffer 1595. In one example, the bias circuitry provides 3 bits for biasing. In another example, the bias circuitry provides 2 bits for biasing. The bias circuitry may be included with processing circuitry 209, system circuitry 208, backlight unit, display circuitry, control circuitry, or matrix drivers.

In one embodiment, modulo PWM offset and bias controls are tuned with processing circuitry (e.g., processing circuitry executing instructions for an algorithm) to achieve a target system performance. FIG. 16A illustrates linearity versus raw pwm code for a diagram 1600 for a pulse with a short rise/fall time. FIG. 16B illustrates an average current versus programmed M-PWM code for a diagram 1610 having an offset setting 1612 to skip a code (e.g., code 22) to skip dead zones in accordance with one embodiment. The offset setting is set such that zero and near zero samples are not used. Offset is set so no possibility of large positive contrast steps considering all sources of variations as illustrated in diagram 1650 of FIG. 16C. FIG. 16D illustrates linearity versus M-PWM code with offset setting.

In another embodiment, FIG. 17A illustrates a linearity versus programmed M-PWM code for a diagram 1700 having no bias adjustment in accordance with one embodiment. The linearity % is +4%/−2% with no bias. FIG. 17B illustrates a linearity versus programmed M-PWM code diagram 1750 having bias adjustment in accordance with one embodiment. The bias adjustment (e.g., 3 bit) is used to adjust linearity % so this error is symmetric, +/−3%.

FIG. 18 illustrates a brightness versus average LED current diagram 1800 for an electronic device in accordance with one embodiment. The diagram 1800 includes different operating regions 1802, 1804, 1806 having different average current levels (e.g., 0-0.25 mA for 1802, 0.25 mA-0.5 mA for 1804, greater than 0.5 mA for 1806) and each operating region can be associated with a different PWM signal depending on a particular display implementation. In one example, a region 1802 is associated with M-PWM 1810 for low current levels, a region 1804 is associated with adaptive PWM 1820 for intermediate current levels, and a region 1806 is associated with PAM 1830 for higher current levels. In this one example, A-PWM is used to avoid acoustic noise and display flicker at intermediate brightness levels. M-PWM is used to improve linearity at low brightness levels where human sensitivity to acoustic noise and flicker is much less.

In one embodiment, an electronic device includes processing circuitry to execute an algorithm to determine a desired brightness level for an array of LEDs, to determine whether the desired brightness level is greater than a threshold brightness level, and to select a PWM or PAM signal based on the whether the desired brightness level is greater than the threshold brightness level. A desired brightness level can be associated with different operating regions 1802, 1804, 1806 and different average ILEA current levels (e.g., 0-0.25 mA, 0.25 mA-0.5 mA, greater than 0.5 mA) of FIG. 18. In one example, a first brightness level is associated with region 1802, a second brightness level is associated with region 1804, and third brightness level is associated with region 1806.

If the processing circuitry determines a desired brightness level below the threshold brightness level, then the display driver circuitry (e.g., LED matrix drivers) generates a signal for lower brightness levels below the threshold brightness level 1850 (e.g., below 0.5 mA, regions 1802 and 1804). The signal includes at least one of an adaptive PWM signal, a first modulo PWM signal, or a second modulo PWM signal for use in controlling the brightness of the array of the LEDs. In one example, the display driver circuitry is configured to generate for lower brightness levels below a threshold brightness level a PWM signal including at least one of a first modulo PWM signal that modifies a pulse width of one pulse per line of a pulse train, a second modulo PWM signal that partitions pulses of backlight updates into groups based on consecutive self-refresh cycles of a backlight update for controlling the brightness of the array of the LEDs, or an adaptive PWM signal that is designed with one pulse being removed from a first group of pulses and a pulse width of each of the other pulses of this first group is increased by a delta width to compensate for a reduction in energy from removing the one pulse.

Each group of the second modulo PWM signal has an integer number N of self-refresh cycles. The backlight update has a scan rate that is an integer multiple of a scan rate of liquid crystal display (LCD) components of a display to synchronize the backlight update to the scan rate of the LCD components.

If the processing circuitry determines a desired brightness level above or equal to the threshold brightness level, then the display driver circuitry (e.g., LED matrix drivers) generates a signal for higher brightness levels above the threshold brightness level 1850 (e.g., region 1806) including a PAM signal.

In accordance with various aspects of the subject disclosure, an electronic device with a display is provided. The display includes an array of light-emitting diodes. The array including a plurality of subarrays of the light-emitting diodes. At least one driver circuit is coupled to the array of light-emitting diodes. The at least one driver circuit is configured to generate an adaptive pulse-width modulated (PWM) signal to control at least one subarray of the plurality of subarrays of the light-emitting diodes. The adaptive PWM signal is designed with each pulse of a group having a pulse width W, each pulse width being reduced until reaching a threshold pulse width, and one pulse being removed from the group of pulses.

In accordance with other aspects of the subject disclosure, a control circuitry includes an array of light emitting diodes (LEDs) having controllable brightness levels and display driver circuitry for driving the array of light emitting diodes (LEDs). The display driver circuitry is configured to generate for lower brightness levels below a threshold brightness level a PWM signal including at least one of a first modulo PWM signal that modifies a pulse width of one pulse per line of a pulse train or a second modulo PWM signal that partitions pulses of backlight updates into groups based on consecutive self-refresh cycles of a backlight update for controlling the brightness of the array of the LEDs.

In accordance with other aspects of the subject disclosure, an electronic device comprises an array of light-emitting diodes (LEDs) and processing circuitry to execute instructions to receive a pulse-width modulated (PWM) code, and to modify the code to generate a modified PWM code having PWM offset functionality. Driver circuitry is coupled to the array of LEDs. The driver circuitry is configured to generate a PWM signal based on the modified PWM code to control the array of the light-emitting diodes with the PWM offset functionality.

In accordance with other aspects of the subject disclosure, an electronic device comprises an array of light-emitting diodes (LEDs) and processing circuitry to execute instructions to receive a pulse-width modulated (PWM) code and to modify the code to generate a modified PWM code having PWM bias functionality. Driver circuitry is coupled to the array of LEDs. The driver circuitry is configured to generate a PWM signal based on the modified PWM code to control the array of the light-emitting diodes with the PWM bias functionality.

In accordance with other aspects of the subject disclosure, an electronic device comprises an array of light-emitting diodes (LEDs) and processing circuitry to execute an algorithm to determine a desired brightness level for the array of LEDs, to determine whether the desired brightness level is greater than a threshold brightness level, and to cause a pulse-width modulated (PWM) signal or pulse-amplitude modulated (PAM) signal to be generated based on whether the desired brightness level is greater than the threshold brightness level.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device with a display, the display comprising:

an array of light-emitting diodes, the array includes a plurality of subarrays of the light-emitting diodes; and at least one driver circuit coupled to the array of light-emitting diodes, wherein the at least one driver circuit is configured to generate an adaptive pulse-width modulated (PWM) signal to control at least one subarray of the plurality of subarrays of the light-emitting diodes, wherein the adaptive PWM signal is designed with each pulse of a group having a pulse width W, each pulse width of the group being reduced until reaching a minimum allowable pulse width to illuminate a light-emitting diode, and one pulse being removed from the group of pulses.

2. The electronic device of claim 1, wherein a pulse width of each of the other pulses of this group is increased by a delta width to compensate for a reduction in energy from removing the one pulse.

3. The electronic device of claim 1, wherein each pulse of the group of pulses is designed with the same width and the same amplitude.

4. The electronic device of claim 1, wherein the adaptive PWM signal has a frequency equal to or greater than 100 kHz.

5. The electronic device of claim 1, wherein the at least one driver circuit comprises a pulse-width modulation (PWM) generator to receive a clock signal and to generate the adaptive PWM signal that is designed for lower brightness levels below a threshold brightness level.

6. A control circuitry, comprising:

an array of light emitting diodes (LEDs) having controllable brightness levels; and display driver circuitry for driving the array of light emitting diodes (LEDs), wherein the display driver circuitry is configured to generate for lower brightness levels below a threshold brightness level a PWM signal including at least one of a first modulo PWM signal that modifies a pulse width of one pulse for each line of a pulse train to generate a fractional pulse width for each line until the fractional pulse width is less than a minimum pulse width to illuminate the array of light emitting diodes (LEDs) or a second modulo PWM signal that partitions pulses of backlight updates into groups based on consecutive self-refresh cycles of a backlight update for controlling the brightness of the array of the LEDs.

7. The control circuitry of claim 6, wherein the display driver circuitry is configured to generate the first modulo PWM signal by setting the minimum pulse width based on luminance of the array of LEDs, compute an integer number of pulses per line of pulse train, and compute a fractional pulse width for the modified pulse.

8. The control circuitry of claim 7, wherein the display driver circuitry is configured to determine if the fractional pulse width is less than the minimum pulse width and remove the modified pulse of the pulse train if the fractional pulse width is less than the minimum pulse width.

9. The control circuitry of claim 8, wherein once the pulse width of the modified pulse reaches the minimum pulse width, the display driver circuitry is configured to remove this modified pulse and to add this energy to a different pulse.

10. The control circuitry of claim 9, wherein the minimum pulse width is 100 to 500 nanoseconds.

11. The control circuitry of claim 6, wherein each group of the second modulo PWM signal has an integer number N of self-refresh cycles.

12. The control circuitry of claim 11, wherein the backlight update has a scan rate that is an integer multiple of a scan rate of liquid crystal display (LCD) components of a display to synchronize the backlight update to the scan rate of the LCD components.

13. The control circuitry of claim 12, wherein the scan rate of each group is 720 hertz and the scan rate of the LCD components is 90 hertz.

14. The control circuitry of claim 11, wherein the backlight updates include a first backlight update that is partitioned into three groups of N self-refresh cycles and a second partial backlight update that is partitioned into two groups.

15. An electronic device, comprising:

an array of light-emitting diodes (LEDs); and driver circuitry coupled to the array of LEDs, wherein the driver circuitry is configured to generate a PWM signal based on a modified pulse-width modulated (PWM) code having PWM offset functionality to control the array of the light-emitting diodes with the PWM offset functionality, wherein the PWM offset functionality causes a positive or negative pulse width to be added to each pulse of the PWM signal that is added for improved linearity of the LEDs.

16. The electronic device of claim 15, wherein the PWM offset functionality skips PWM code that is associated with non-linear regions for output luminance of the LEDs.

17. The electronic device of claim 15, further comprising:

processing circuitry to execute instructions to receive a pulse-width modulated (PWM) code and to modify the code to generate the modified PWM code having the PWM offset functionality.

18. The electronic device of claim 17, wherein the processing circuitry is configured to execute instructions to receive a pulse-amplitude modulated (PAM) code and to modify the code to generate a modified PAM code having PAM offset functionality.

19. An electronic device, comprising:

an array of light-emitting diodes (LEDs);

processing circuitry to execute instructions to receive a pulse-width modulated (PWM) code and to modify the code to generate a modified PWM code having PWM bias functionality; and driver circuitry coupled to the array of LEDs, wherein the driver circuitry is configured to generate a PWM signal based on the modified PWM code to control the array of the light-emitting diodes with the PWM bias functionality, wherein the PWM bias functionality causes a correction of a bias luminance error.

20. The electronic device of claim 19, wherein the PWM bias functionality causes a correction of a bias luminance error to reduce error and improve linearity.

21. The electronic device of claim 19, wherein additional bits provide the PWM bias functionality.

22. An electronic device, comprising:

an array of light-emitting diodes (LEDs); and processing circuitry to execute an algorithm to determine a desired brightness level for the array of LEDs, to determine whether the desired brightness level is greater than a threshold brightness level, and to cause a pulse-width modulated (PWM) signal to be generated when the desired brightness level is below the threshold brightness level, and to cause a pulse-amplitude modulated (PAM) signal to be generated when the desired brightness level is greater than the threshold brightness level.

23. The electronic device of claim 22, further comprising: display driver circuitry coupled to the array of LEDs, the display driver circuitry is configured to generate the pulse-width modulated (PWM) signal for lower brightness levels below the threshold brightness level when the desired brightness level is below the threshold brightness level.

24. The electronic device of claim 23, wherein the PWM signal comprises at least one of an adaptive PWM signal, a first modulo PWM signal that modifies a pulse width of one pulse per line of a pulse train, or a second modulo PWM signal that partitions pulses of backlight updates into groups based on consecutive self-refresh cycles of a backlight update for controlling the brightness of the array of the LEDs, wherein the first and second modulo PWM signals have natural x-point calibration for settling errors with no actual calibration required with x being a number of pulses per backlight update.

25. The electronic device of claim 23, wherein the display driver circuitry is configured to generate the PAM signal when the desired brightness level is above or equal to the threshold brightness level.

* * * * *